US008887335B2

(12) United States Patent
Gant et al.

(10) Patent No.: US 8,887,335 B2
(45) Date of Patent: Nov. 18, 2014

(54) PORTABLE CHANGING TABLE

(71) Applicants: Alexis Gant, Winchester, CA (US); Justin Gant, Mukilteo, WA (US)

(72) Inventors: Alexis Gant, Winchester, CA (US); Justin Gant, Mukilteo, WA (US)

( * ) Notice: Subject to any disclaimer, the term of this patent is extended or adjusted under 35 U.S.C. 154(b) by 0 days.

(21) Appl. No.: 14/223,763

(22) Filed: Mar. 24, 2014

(65) Prior Publication Data

US 2014/0201920 A1 Jul. 24, 2014

Related U.S. Application Data

(63) Continuation-in-part of application No. 13/632,952, filed on Oct. 1, 2012, now Pat. No. 8,677,534, which is a continuation-in-part of application No. 13/187,400, filed on Jul. 20, 2011, now Pat. No. 8,276,228, which is a continuation of application No. 12/884,090, filed on Sep. 16, 2010, now Pat. No. 8,001,637.

(60) Provisional application No. 61/242,899, filed on Sep. 16, 2009.

(51) Int. Cl.
*A47C 21/08* (2006.01)

(52) U.S. Cl.
USPC ..... 5/655; 5/947

(58) Field of Classification Search
USPC ..... 5/655, 947; 108/42, 48
See application file for complete search history.

(56) References Cited

U.S. PATENT DOCUMENTS

| | | | | |
|---|---|---|---|---|
| 3,644,947 | A | 2/1972 | Padera | |
| 4,862,611 | A | 9/1989 | Wright | |
| 5,170,719 | A | 12/1992 | Pestone | |
| 5,483,761 | A | 1/1996 | Simpson | |
| 6,282,084 | B1 | 8/2001 | Goerdt | |
| 6,470,517 | B1 | 10/2002 | Kang | |
| 7,395,620 | B1 | 7/2008 | McNeely | |
| 8,001,637 | B1 | 8/2011 | Gant | |
| 8,651,571 | B1 * | 2/2014 | Richardson | 297/217.7 |
| 2010/0138995 | A1 | 6/2010 | Smith | |

* cited by examiner

*Primary Examiner* — Fredrick Conley
(74) *Attorney, Agent, or Firm* — Christensen O'Connor Johnson Kindness PLLC

(57) ABSTRACT

A portable changing table includes at least one extendable arm assembly moveable between a retracted position and an extended position. The at least one extendable arm assembly is removably securable to a support structure, and it includes a biasing member for urging the at least one extendable arm assembly into the retracted position. The table further includes a latch assembly that is configured to selectively secure the at least one extendable arm assembly in the retracted position. A collapsible frame is hingedly secured to the at least one extendable arm assembly that is moveable between a stowed position and a deployed position. A flexible support member extends across a portion of the collapsible frame in the deployed position.

16 Claims, 17 Drawing Sheets

PORTABLE CHANGING TABLE

CROSS-REFERENCES TO RELATED APPLICATIONS NOTE

This application is a continuation-in-part of application Ser. No. 13/632,952, filed Oct. 1, 2012, which is a continuation-in-part of application Ser. No. 13/187,400, filed Jul. 20, 2011, now U.S. Pat. No. 8,276,228, issued Oct. 2, 2012, which is a continuation of application Ser. No. 12/884,090, filed Sep. 16, 2010, now U.S. Pat. No. 8,001,637, issued Aug. 23, 2011, and which claims the benefit of Provisional Application No. 61/242,899, filed Sep. 16, 2009, the disclosures of which are hereby expressly incorporated herein by reference.

BACKGROUND

Parents and caregivers of infants and young children that wear diapers are frequently obliged to perform diaper changes away from home. The most convenient place to perform a diaper change is usually in a public restroom. However, many public restrooms, particularly men's restrooms, do not provide a diaper changing station. In restrooms where there is a diaper changing station, the diaper changing station is often soiled or even broken. Parents and caregivers are faced with the choice of using a dirty and potentially unsafe diaper changing station, the restroom counter, or the restroom floor to change the infant's or child's diaper. Thus, there exists a need for a changing table that is sufficiently portable and compact so as to provide a safe and sanitary surface for performing diaper changes on the go.

SUMMARY

A portable changing table of the present disclosure includes at least one extendable arm assembly moveable between a retracted position and an extended position. The at least one extendable arm assembly is removably securable to a support structure. The portable changing table further includes a collapsible frame hingedly secured to the at least one extendable arm assembly, wherein the collapsible frame is moveable between a stowed position and a deployed position. The portable changing table further includes a flexible support member secured to a portion of the collapsible frame. The flexible support member extends across a portion of the collapsible frame in the deployed position.

In an alternate embodiment, a portable changing table includes at least one extendable arm assembly moveable between a retracted position and an extended position. The at least one extendable arm assembly is removably securable to a support structure. The portable changing table further includes a collapsible frame with a first frame member assembly having a first telescoping member. A portion of the first frame member assembly is moveable relative to the first telescoping member into at least first and second positions. The collapsible frame further includes a second frame member assembly having a second telescoping member, wherein a portion of the second frame member assembly is moveable relative to the second telescoping member into at least first and second positions. A flexible support member is secured to a portion of the collapsible frame.

In another embodiment, a portable changing table includes at least one extendable arm assembly moveable between a refracted position and an extended position. The at least one extendable arm assembly is removably securable to a support structure, and it includes a biasing member for urging the at least one extendable arm assembly into the retracted position.

The table further includes a latch assembly that is configured to selectively secure the at least one extendable arm assembly in the retracted position. A collapsible frame is hingedly secured to the at least one extendable arm assembly that is moveable between a stowed position and a deployed position. A flexible support member extends across a portion of the collapsible frame in the deployed position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
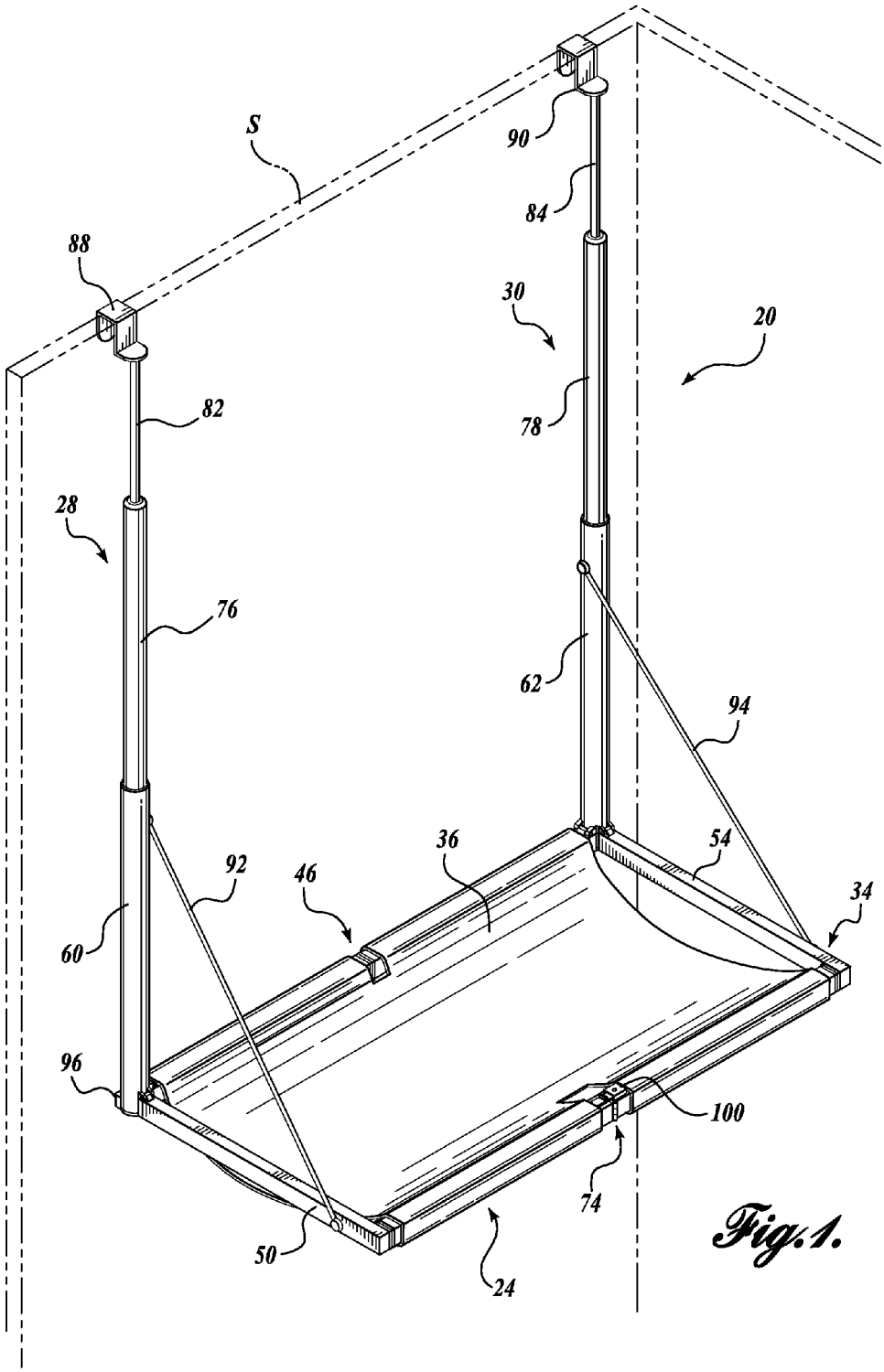
FIG. 1 is an isometric view of a portable changing table formed in accordance with one embodiment of the present disclosure, wherein the portable changing table is shown in a deployed position.

A portable changing table 20 formed in accordance with one embodiment of the present disclosure may best be understood by referring to FIG. 1. Generally described, the portable changing table 20 includes a collapsible base 24 hingedly coupled to first and second extendable arm assemblies 28 and 30. The first and second extendable arm assemblies 28 and 30 are removably securable to, for instance, an upper portion of a bathroom stall S. Once secured to the bathroom stall S, the arm assemblies 28 and 30 extend and the base 24 may be deployed so that a baby may be placed on the base 24 to change the baby's diaper. After use, the extendable arm assemblies 28 and 30 are retracted and the base 24 is collapsed to conveniently stow and transport the portable changing table 20 within, for instance, a diaper bag.

Although the portable changing table 20 will be hereinafter described as being suitable for changing a baby's diaper within a bathroom stall, it should be appreciated that the portable changing table 20 may instead be used in any other suitable manner or in any desired environment or situation. Moreover, although the portable changing table 20 is described as being compact and portable when in the collapsed position, such as to fit within a diaper bag or purse, the portable changing table 20 may be any desired size. Thus, the following description and illustrations herein should not be seen as limiting the scope of the present disclosure.

Figure 2:
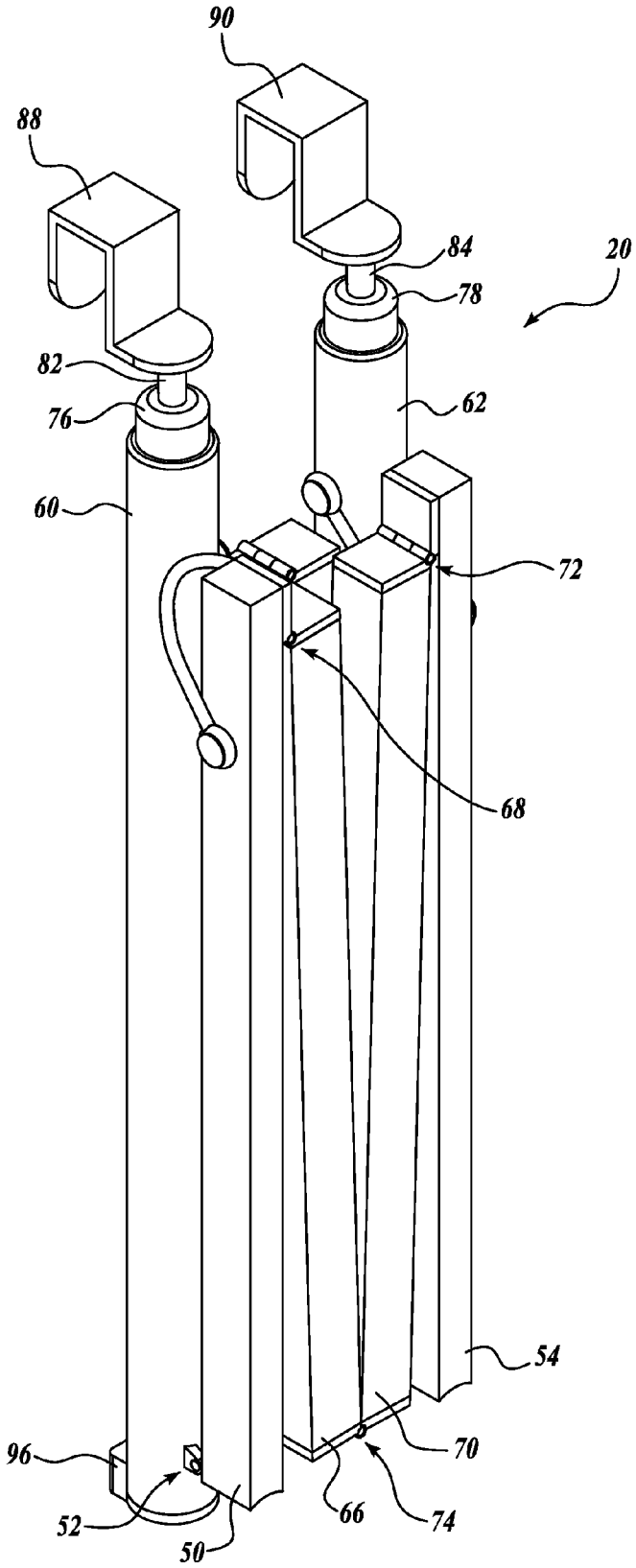
FIG. 2 is an isometric view of the portable changing table of FIG. 1 shown in a collapsed position, wherein a pad of the portable changing table has been removed.
Figure 3:
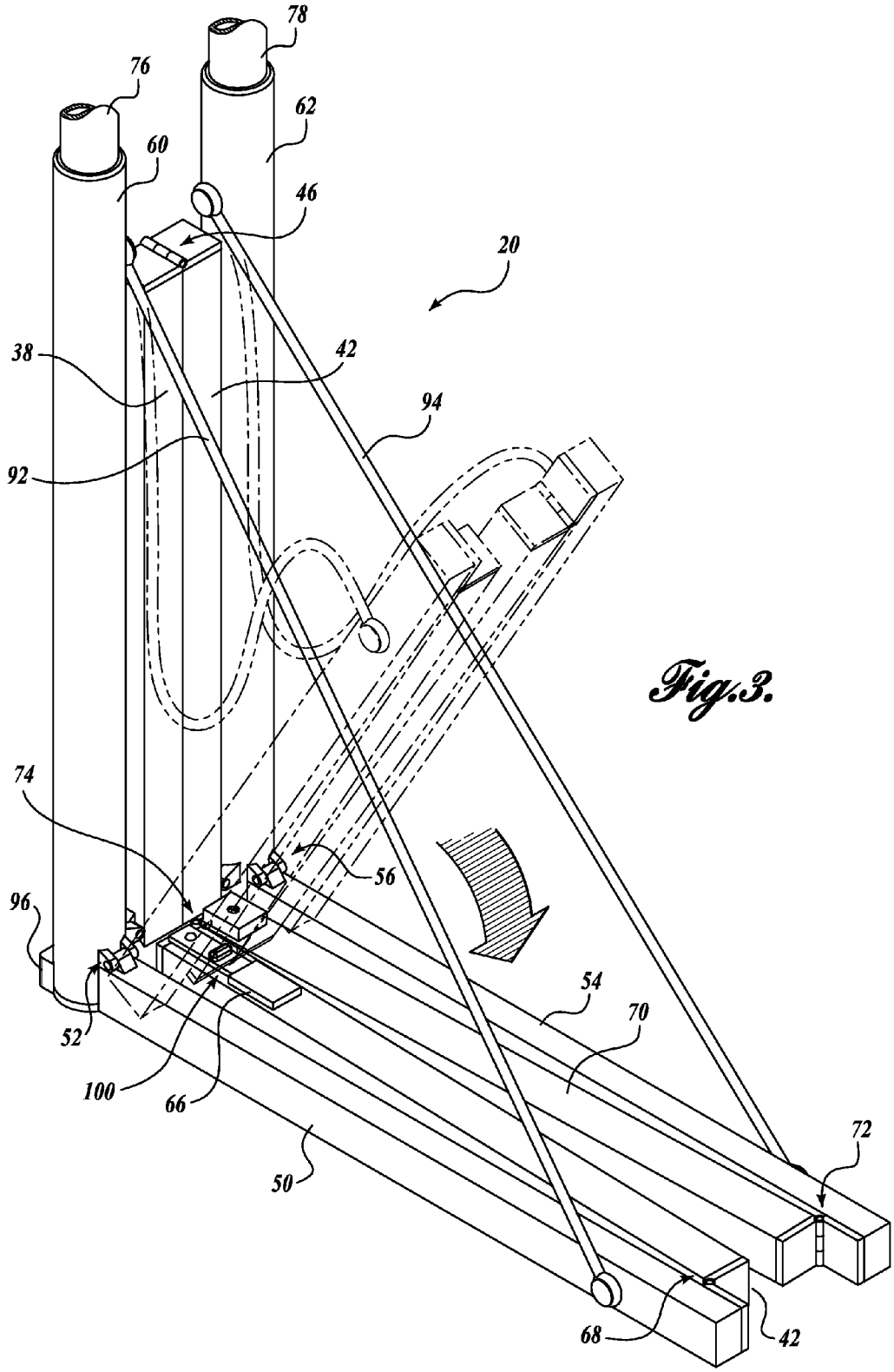
FIG. 3 is an isometric view of the portable changing table of FIG. 2 shown being moved into a deployed position.
Figure 4:
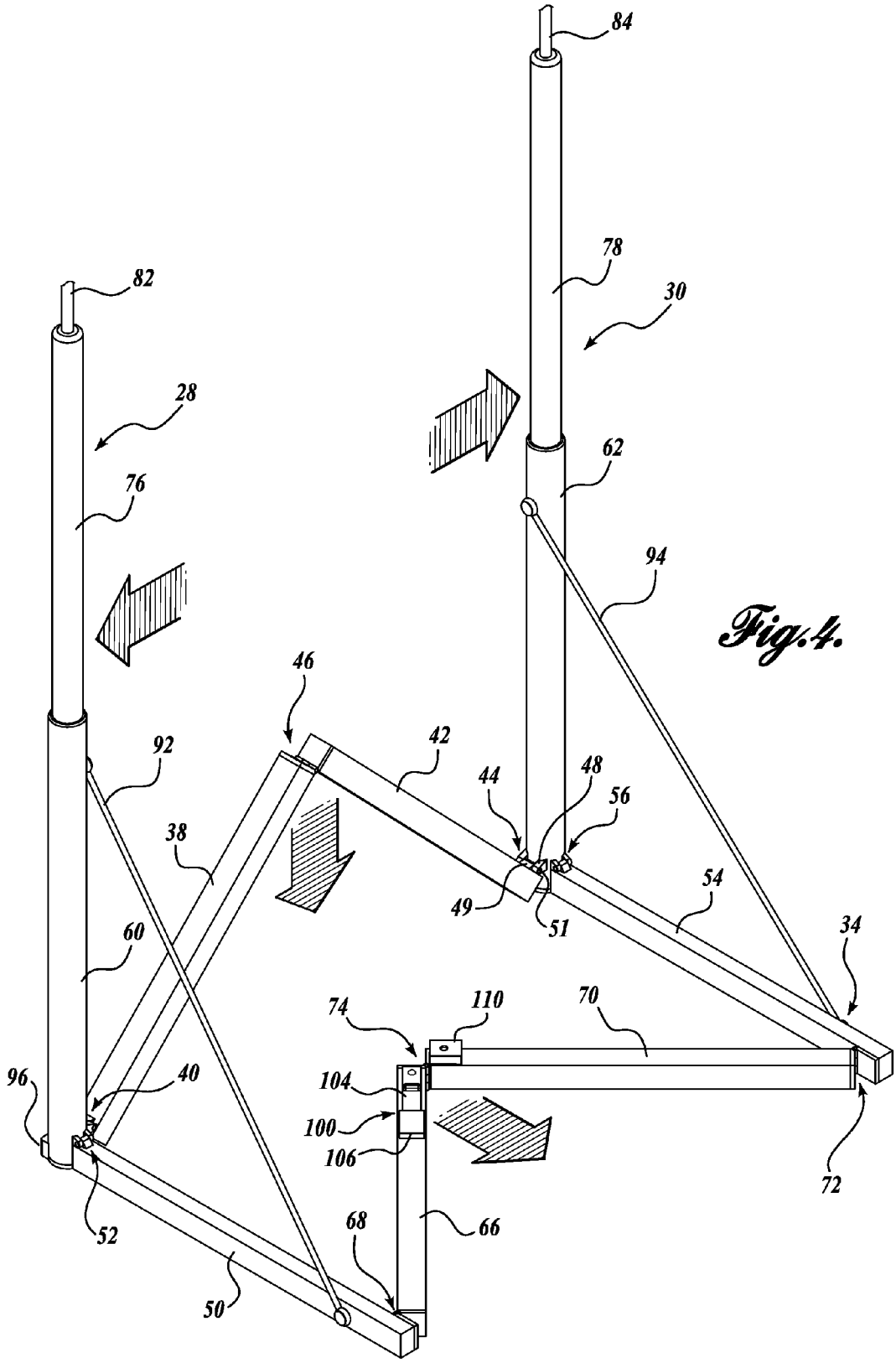
FIG. 4 is an isometric view of the portable changing table of FIG. 2 shown being moved into a further deployed position.

Referring to FIGS. 1-4, the collapsible base 24 of the portable changing table 20 will now be described in detail. Referring specifically to FIG. 4, the collapsible base 24 includes a frame 34 that is deployable into a substantially rectangular shape and a flexible support member, or diaper changing pad 36 secured to the frame 34. The frame 34 includes a first rear frame member 38 hingedly coupled to a portion of the first extendable arm assembly 28 at its first end and a second rear frame member 42 hingedly coupled to a portion of the second extendable arm assembly 30 at its first end. Although the first and second extendable arm assemblies 28 and 30 will be described in further detail below, the first and second extendable arm assemblies 28 and 30 include tubular bodies 60 and 62 at their lower ends. The first and second rear frame members 38 and 42 are hingedly coupled to the first and second tubular bodies 60 and 62 through first and second rear hinge assemblies 40 and 44.

The first and second rear hinge assemblies 40 and 44 may be any suitable hinge assemblies configured to allow the first and second rear frame members 38 and 42 to move between a collapsed position, wherein the first and second rear frame members 38 and 42 are positioned substantially parallel to one another between the first and second tubular bodies 60 and 62 (see FIGS. 2 and 3), and a deployed position, wherein the first and second rear frame members are in substantially axial alignment with one another and are substantially transverse to the longitudinal axes of the first and second tubular bodies 60 and 62 (see FIG. 1).

For instance, each hinge assembly 40 and 44 may include a well-known hinge yoke 48 secured to or otherwise formed on the tubular body of the extendable arm assembly, and a hinge pin collar 49 secured to or otherwise formed on the first end of the rear frame member that is received within the hinge yoke 48. A hinge pin 51 extends through the hinge yoke 48 and the hinge pin collar 49 to define a pivot axis and to hingedly couple the first end of the rear frame member to the corresponding tubular body. It should be appreciated that any other suitable hinge assembly may instead be used to hingedly couple the first and second rear frame members 38 and 42 to the first and second tubular bodies 60 and 62.

Moreover, in the embodiment depicted, the first and second rear frame members 38 and 42 have a substantially square or rectangular cross-section. In that regard, the first ends of the first and second rear frame members 38 and 42 may be contoured (see the contour of frame members 50 and 54 shown in FIG. 2) to engage and mate with the curved exterior of the first and second tubular bodies 60 and 62 when the frame 34 is in the deployed position to help stabilize the frame members in a substantially transverse position against the tubular bodies. However, it should be appreciated that the first and second rear frame members 38 and 42, as well as the other portions of the frame 34 may be any suitable cross-sectional shape, such as round, oval, etc. Moreover, as will be described below, the tubular bodies 60 and 62 may also be any suitable cross-sectional shape, such as square.

The first and second rear frame members 38 and 42 are hingedly coupled to one another at their second ends through a middle rear hinge assembly 46. The middle rear hinge assembly 46 may be any suitable hinge assembly configured to allow the first and second rear frame members 38 and 42 to move between a collapsed position, wherein the first and second rear frame members 38 and 42 are positioned substantially parallel to one another between the first and second tubular bodies 60 and 62 (see FIGS. 2 and 3), and a deployed position, wherein the first and second rear frame members are in substantially axial alignment with one another and are substantially transverse to the longitudinal axes of the first and second tubular bodies 60 and 62 (see FIG. 1). In the embodiment depicted, the middle rear hinge assembly 46 is a continuous hinge, such as a piano hinge, that allows the second end surfaces of the first and second rear frame members 38 and 42 to substantially abut one another in the deployed position.

The frame 34 further includes first and second side frame members 50 and 54 extending from and hingedly coupled to the first and second tubular bodies 60 and 62 of the first and second extendable arm assemblies 28 and 30. The first and second side frame members 50 and 54 are hingedly coupled to the first and second tubular bodies 60 and 62 through suitable first and second side hinge assemblies 52 and 56. Although any suitable hinge assembly may be used, the first and second side hinge assemblies 52 and 56 are substantially similar to the hinge assemblies 40 and 44 described above.

The first and second side frame members 50 and 54 are hingedly coupled to the first and second tubular bodies 60 and 62 such that the first and second side frame members 50 and 54 may be moved between a collapsed position, wherein the first and second side frame members 50 and 54 are positioned substantially parallel to the first and second tubular members 60 and 62, and a deployed position, wherein the first and second side frame members 50 and 54 are substantially transverse to the first and second rear frame members 38 and 42 and the first and second tubular bodies 60 and 62. Although the first and second side frame members 50 and 54 may be any suitable shape and configuration, in the depicted embodiment, the first and second side frame members 50 and 54 have a substantially square or rectangular cross-sectional shape, similar to the first and second rear frame members 38 and 42 described above. In that regard, the first end of the first and second side frame members 50 and 54 that is hingedly coupled to the first and second tubular bodies 60 and 62 may be contoured (see FIG. 3) to engage and mate with the first and second tubular bodies 60 and 62 in the deployed position.

The frame 34 further includes first and second front frame members 66 and 70 that are hingedly coupled at their first ends to the first and second side frame members 50 and 54, respectively, through first and second front hinge assemblies 68 and 72. Although any suitable hinge assemblies may be used, the first and second front hinge assemblies 68 and 72 are shown as continuous hinges, similar to the middle rear hinge assembly 46 described above. In this manner, the first and second front frame members 66 and 70 may be moved into a deployed position with the first and second front frame members 66 and 70 being positioned substantially transversely to the first and second side frame members 50 and 54.

The first and second front frame members 66 and 70 are hingedly coupled together through a middle front hinge assembly 74 of any suitable design, such as a continuous hinge similar to hinge assemblies 68 and 72. As such, the first and second front frame members 66 and 70 may be moved between a collapsed position, wherein the first and second front frame members are substantially parallel to one another (see FIGS. 2 and 3), and a deployed position, wherein the first and second front frame members 66 and 70 are positioned in substantial axial alignment to one another and are substantially transverse to the first and second side frame members 50 and 54 (see FIG. 1).

As can be seen by referring to FIGS. 1-4, the frame 34 is moved between the collapsed and deployed positions by moving the frame members about the pivot axes defined by the hinge assemblies. In the deployed position, as shown in FIG. 1, the frame 34 is positioned substantially transversely to the tubular bodies 60 and 62. The diaper changing pad 36 extends across the frame 34 to receive a baby thereon. In the embodiment depicted, the diaper changing pad 36 is a piece of suitably durable fabric extending between the rear and front frame members 38 and 42 and 66 and 70, similar to a sling seat. As such, the diaper changing pad 36 may be collapsed within the frame members when the frame 34 is moved into the collapsed position. However, it should be appreciated that the diaper changing pad 36 may be any suitable material, such as foam or a layered foam and fabric construction. A safety strap (not shown) may also be provided to temporarily secure the baby on the pad 36.

The frame 34 is shown in the collapsed position in FIG. 2. To move the frame 34 into the collapsed position, the frame members are moved about the corresponding hinge assemblies to position each of the frame members in a substantially upright position, with each of the frame members being substantially parallel to and adjacent to one another and substantially parallel to the tubular bodies 60 and 62. It can be appreciated that in the collapsed position, the portable changing table 20 is suitable to be stowed and transported within, for instance, a diaper bag or purse.

Referring to FIG. 3, to move the frame 34 into the deployed position, the first and second side frame members 50 and 54 are moved about the pivot axes defined by side hinge assemblies 52 and 56 until the first and second side frame members 50 and 54 are positioned substantially transversely to the tubular bodies 60 and 62. As can be seen in FIG. 3, the ends of the first and second side frame members 50 and 54 engage the exterior of the first and second tubular bodies 60 and 62 to limit the travel of the first and second side frame members 50 and 54 and to position the first and second side frame members 50 and 54 substantially transversely to the first and second tubular bodies 60 and 62. However, it should be appreciated that the side hinge assemblies 52 and 56 may instead be configured to limit the movement of the first and second tubular bodies 60 and 62.

During or after the deployment of the first and second side frame members 50 and 54, the first and second rear frame members 38 and 42 and the first and second front frame members 66 and 70 may be deployed. Referring to FIG. 4, the first and second tubular bodies 60 and 62 are moved away from each other to move the first and second rear frame members 38 and 42 about the rear hinge assemblies 40, 44, and 46 and to move the first and second front frame members 66 and 70 about the middle front hinge assembly 74. The first and second tubular bodies 60 and 62 are moved away from each until the first and second rear frame members 38 and 42 are in substantial axial alignment and the first and second front frame members 66 and 70 are in substantial axial alignment. In this manner, the rear, front, and side frame members of the frame 34 define a substantially rectangular, deployed base 24.

It can be appreciated that when the extendable arm assemblies 28 and 30 are secured to a support structure (as will be described below), the rear frame members 38 and 42 and the side frame members 50 and 54 remain in a deployed, substantially transverse position relative to the tubular bodies 60 and 64 due to gravitational effects. However, the front frame members 66 and 70 could move about the middle front hinge assembly 74 when in use. In that regard, a locking or latch mechanism 100 may be secured to a portion of the first and second front frame members 66 and 70 together to temporarily lock the front frame members 66 and 70 in the deployed position.

Figure 5A:
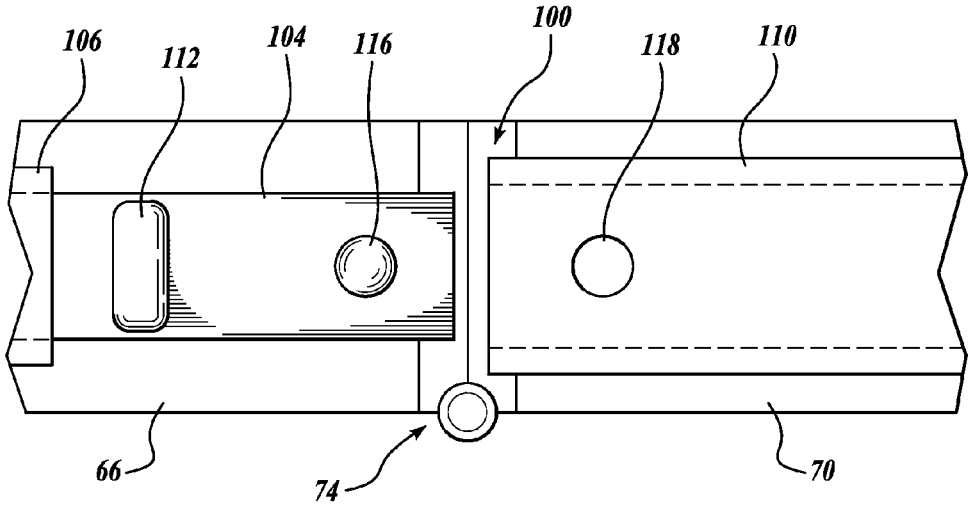
FIG. 5A is a latch mechanism for use with the portable changing table of FIG. 1, wherein the latch mechanism is shown in an unlocked position.
Figure 5B:
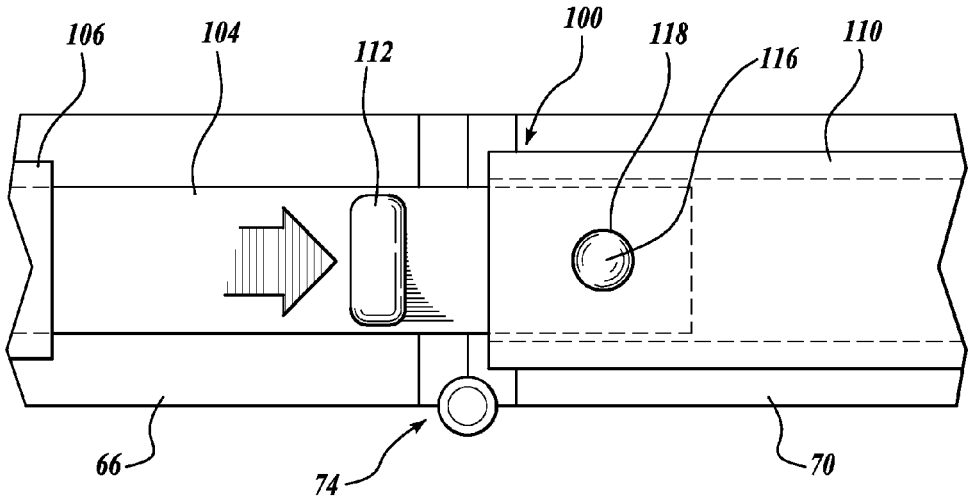
FIG. 5B is a latch mechanism for use with the portable changing table of FIG. 1, wherein the latch mechanism is shown in a locked position.

Referring to FIGS. 5A and 5B, the latch mechanism 100 may be any suitable design configured to temporarily lock or secure the front frame members 66 and 70 in the deployed position. In the depicted embodiment, the latch mechanism 100 includes a locking member 104 slidably received within a first locking member sleeve or receptacle 106 secured to or otherwise formed on an exterior surface of the first front frame member 66 near the middle front hinge assembly 74. The locking member 104 is slidably receivable within a second locking member sleeve or receptacle 110 secured to or otherwise formed on an exterior surface of the second front frame member 70 near the middle front hinge assembly 74. A knob or handle 112 may be provided on the locking member 104 to help move the locking member 104 into and out of engagement with the second locking member receptacle 110.

With the locking member 104 extending across the joint defined between the first and second front frame members 66 and 70, the first and second front frame members 66 and 70 cannot move about the pivot axis defined by the middle front hinge assembly 74. As such, the first and second front frame members 66 and 70 are temporarily locked in the deployed position.

To secure the locking member 104 in this locked position, the latch mechanism 100 may include a lock detent mechanism having a lock detent, such as a spring-loaded ball or clip, receivable within a corresponding hole 118 formed in the outer surface of the second locking member receptacle 110. The lock detent 116 may be depressed when sliding the locking member 104 within the second locking member receptacle 110 until the lock detent 116 is received within the hole 108. If the lock detent 116 is a spring-loaded ball, the lock detent 116 will be urged upwardly within the hole 108 as it reaches the hole 108, thereby providing a tactile sensation to the user that the latch mechanism 100 is locked.

To unlock the latch mechanism 100, the lock detent 116 is depressed until the locking member 104 can be slid outwardly from within the second locking member receptacle 110. It should be appreciated that any other suitable lock detent mechanism or locking device may instead be used. Moreover, it should be appreciated that the latch mechanism 100 may instead be any other suitable design, such as a thumb turn latch, a lock barrel latch, etc. Accordingly, the foregoing description and illustrations herein should not be seen as limiting the scope of the claimed subject matter.

Referring back to FIGS. 1-4, the frame 34 is hingedly coupled to the first and second tubular bodies 60 and 62 of the first and second extendable arm assemblies 28 and 30, as generally described above. The first and second extendable arm assemblies 28 and 30 extend substantially transversely upwardly from the frame 34 when the frame 34 is in the deployed position.

The first and second extendable arm assemblies 28 and 30 are of a suitable design such that the assemblies may be moved between a collapsed, stowed position and an extended, changing table position. Although any suitable design may be used, the depicted first and second extendable arm assemblies 28 and 30 have telescoping features to allow the first and second extendable arm assemblies 28 and 30 to move between the collapsed and extended positions.

In general, each of the first and second extendable arm assemblies 28 and 30 include first and second extension tubes 76 and 78 slidably received within an upper open end of the first and second tubular bodies 60 and 62. Moreover, first and second mounting rods 82 and 84 are slidably received within an upper open end of the first and second extension tubes 76 and 78. The extendable arm assemblies 28 are configured It should be appreciated that the first and second extendable arm assemblies 28 and 30 may include fewer or more telescoping features to shorten or lengthen the overall length of the extendable arm assemblies 28 and 30.

First and second hooks 88 and 90 are secured to the upper ends of the first and second mounting rods 82 and 84. The first and second hooks 88 and 90 are configured to suitably mount the first and second extendable arm assemblies 28 and 30 to a support structure, such as the upper edge of a bathroom stall S. In that regard, any other suitable mounting structure (such as a loop securable on a hook or a peg, a latch mechanism, etc.) may be used to secure the portable changing table 20 to a similar or a different support structure. The hooks 88 and 90 may be coated or covered with a suitable non-slip surface or material, such as rubber, to help stabilize and securely position the hooks 88 and 90 on the support structure.

Furthermore, one or more bumpers 96 or non-slip pads (made from rubber or another suitable material) may be secured to a bottom portion of the extendable arm assemblies 28, and 30, or any other portion of the portable changing table 20 that engages the support structure S to further stabilize the portable changing table 20 against the support structure S. For instance, a bumper 96 may be secured at the lower end of each tubular body 60 and 62.

Referring to FIGS. 6-9, an exemplary telescoping design suitable for allowing the extendable arm assemblies 28 and 30 to move between a collapsed, portable position, and an extended changing table position will be hereinafter described in detail. It should be appreciated that the first and second extendable arm assemblies 28 and 30 are substantially identical in design; and therefore, only the first extendable arm assembly 28 will be hereinafter described in further detail.

Figure 6:
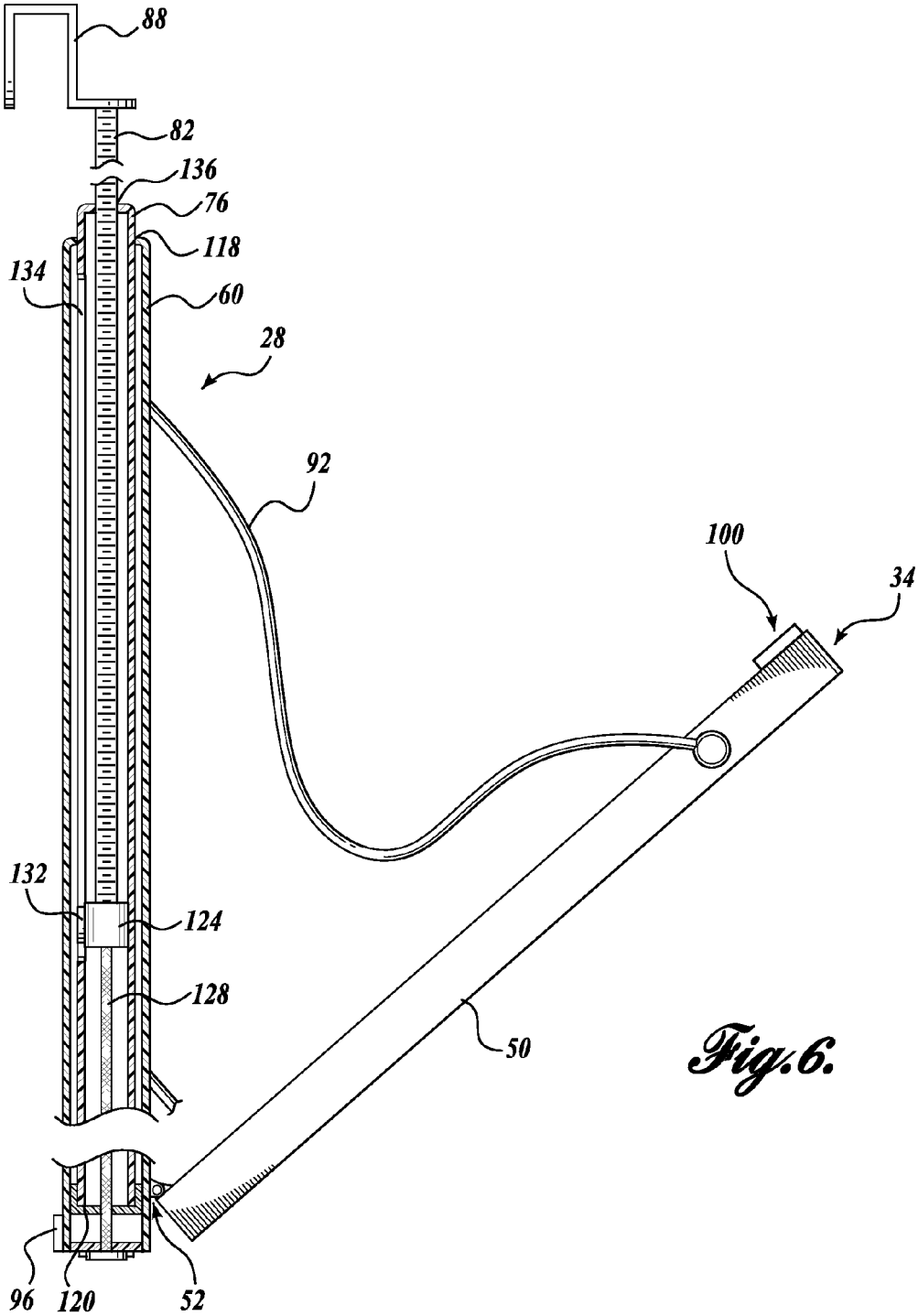
FIG. 6 is a partial cross-sectional side view of the portable changing table of FIG. 1 shown in a partially deployed position.
Figure 7:
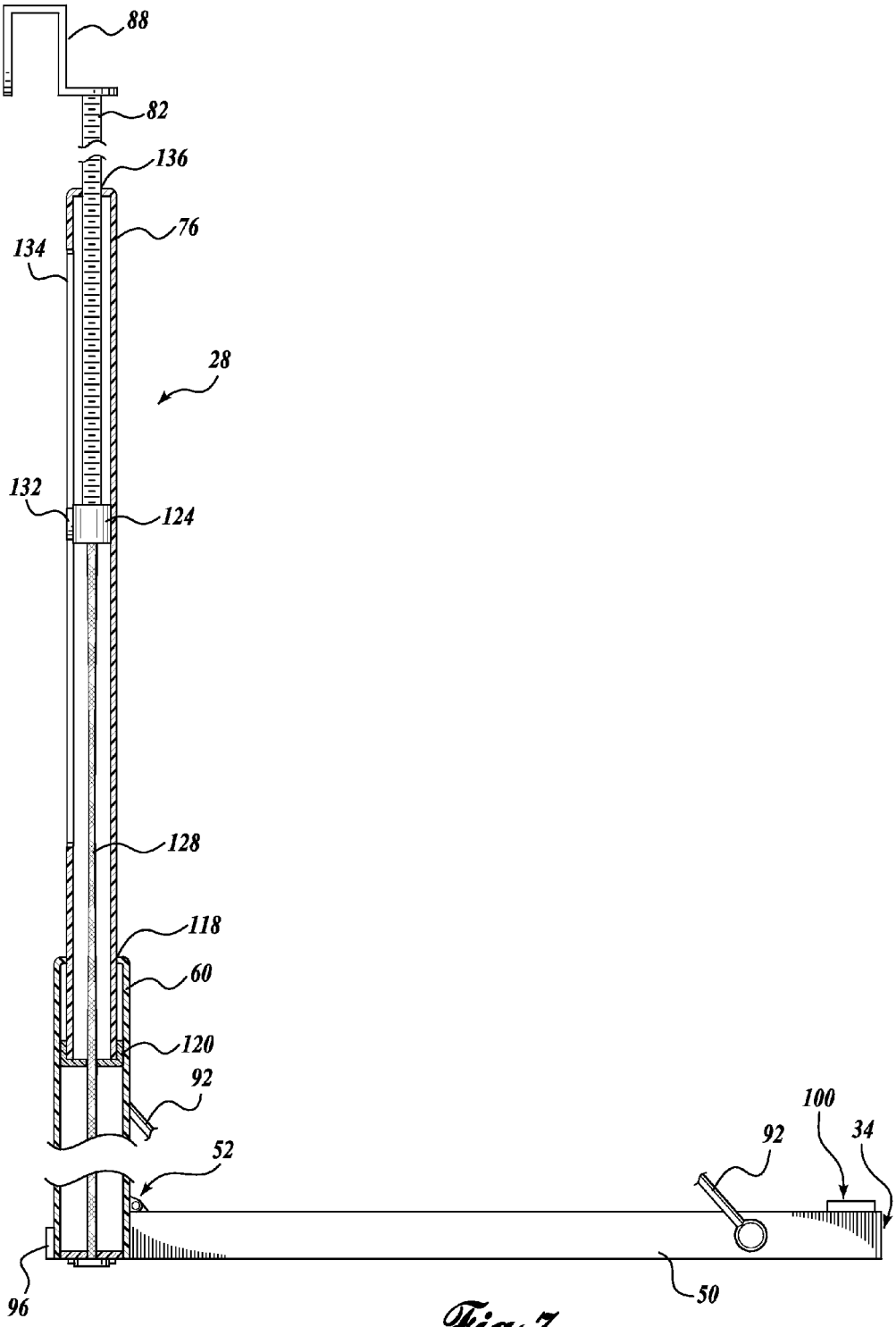
FIG. 7 is a partial cross-sectional side view of the portable changing table of FIG. 1 shown in a deployed position.

Referring specifically to FIGS. 6 and 7, the first extendable arm assembly 28 includes a first extension tube 76 slidably received within an upper open end of the first tubular body 60. The first extension tube 76 and first tubular body 60 are substantially cylindrical in shape (and circular in cross-section) such that the first extension tube 76 may slide linearly within the first tubular body 60. However, it should be appreciated that the first extension tube 76 and first tubular body 60 may instead be any suitable cross-sectional shape, such as square, rectangular, or another polygonal shape. For instance, if the first extension tube 76 was the same polygonal cross-sectional shape as the first tubular body 60 (such as square), the first extension tube 76 would not rotate within the first tubular body 60 during linear translation.

The first extension tube 76 includes an end stop 120 secured to its lower end. In the depicted embodiment, the end stop 120 is configured as a cap received on the lower end of the first extension tube 76. The end stop 120 is greater in width than the first extension tube 76 such that the end stop 120 is engageable with the upper interior surface of the first tubular body 60 when the first extension tube 76 is fully extended. As such, the end stop 120 limits the linear movement of the first extension tube 76 and retains the first extension tube 76 within the first tubular body 60. The end stop 120 may also be made from a suitable low-friction material to act as a linear bushing for the first extension tube 76 when moving within the first tubular body 60. It should be appreciated that other mechanisms for guiding and restraining the movement of the first extension tube 76 within the first tubular body 60 may also be used.

The first extension tube 76 slidably receives the first mounting rod 82 therein. The first mounting rod 82 is adjustably secured within a bushing 124 at its lower end, wherein the bushing 124 is sized and configured to help guide the linear movement of the first mounting rod 82 within the first extension tube 76. The bushing 124 may abut the interior upper surface of the first extension tube 76 to limit the linear travel of the first mounting rod 82 and to retain the first mounting rod 82 within the first extension tube 76.

The bushing 124 may include a bushing key 132 protruding from its exterior surface that is receivable within a slot 134 extending longitudinally along at least a portion of the length of the first extension tube 76. The interaction of the bushing key 132 and the slot 134 substantially prevents the bushing 124, and therefore the first mounting rod 82, from rotating within the first extension tube 76. The slot 134 may also be of a predetermined length to limit the linear travel of the first mounting rod 82 within the first extension tube 76.

The first mounting rod 82 is also secured at its lower end to a biasing member 128 through any suitable means (not shown). In the depicted embodiment, the biasing member 128 is an elastic cord that extends between the lower end of the first mounting rod 82 and the lower end of the first tubular body 60 to bias the first mounting rod 82 into a refracted position within the first extension tube 76. The biasing member 128 extends through an opening (not labeled) in the end stop 120 of the first extension tube 76 and is secured to the lower end of the first tubular body 60 with any suitable means, such as with a knot or fastener. The biasing member 128 helps move the extendable arm assembly 28 into the collapsed position after use. It should be appreciated that any suitable biasing member may instead be used, such as an extension spring, a gas strut, etc.

Figure 8:
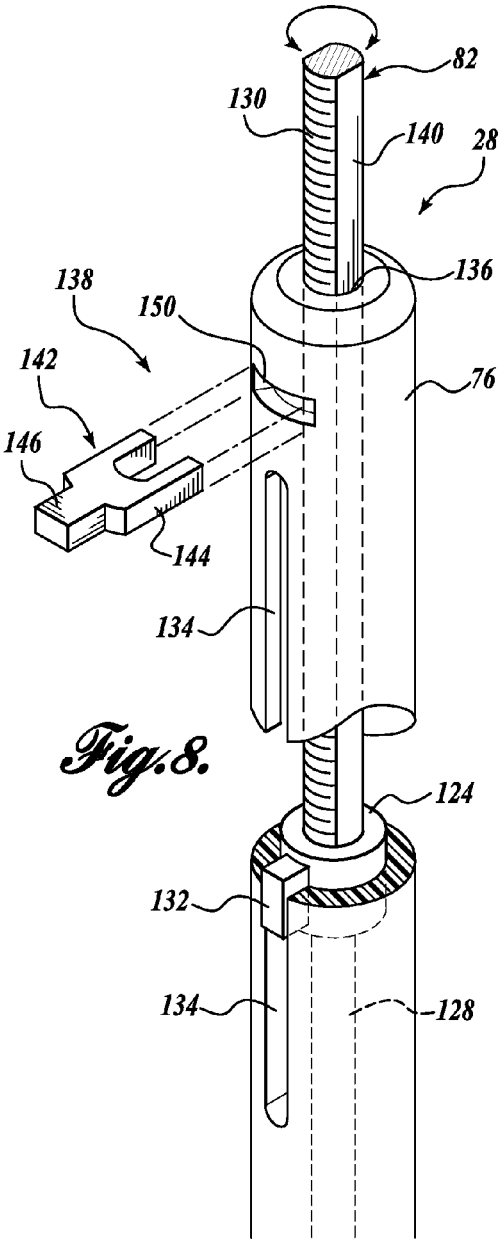
FIG. 8 is an isometric view of a portion of an arm assembly of the portable changing table of FIG. 1, wherein the arm assembly is shown in a first position.
Figure 9:
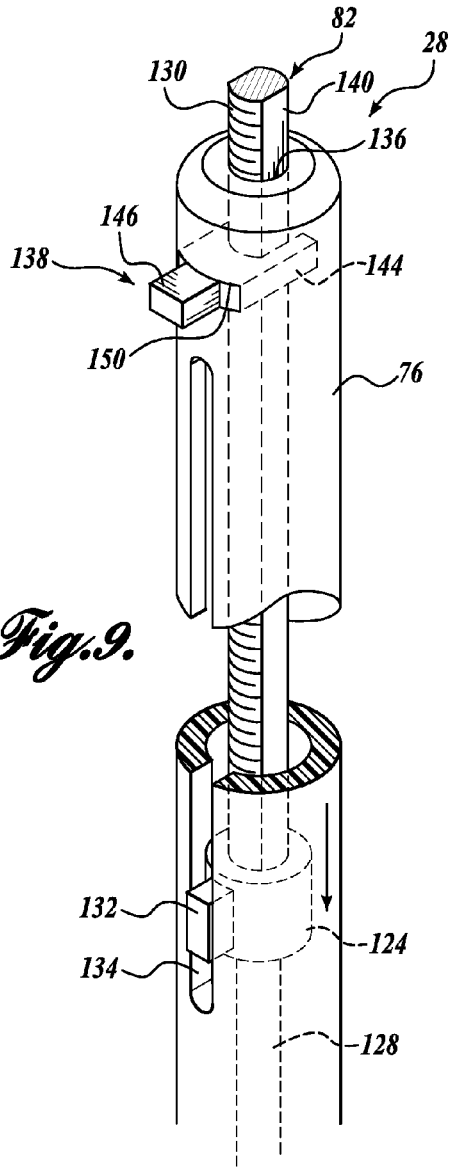
FIG. 9 is an isometric view of a portion of an arm assembly of the portable changing table of FIG. 1, wherein the arm assembly is shown in a second position.

Referring to FIGS. 8 and 9, an exemplary configuration of an adjustment assembly for adjustably mounting the first mounting rod 82 within the bushing 124 will now be described in detail. In the illustrated embodiment, the first mounting rod 82 has longitudinal opposing threaded exterior surfaces 130 (only one shown) interspaced by longitudinal opposing chamfered exterior surfaces 140 (only one shown). The first mounting rod 82 is rotatable within a rod opening 136 in the upper end of the first extension tube 76 such that the bottom end of the first mounting rod 82 may be threaded within a threaded opening (not shown) in the bushing 124. With the bushing key 132 received within the slot 134, the bushing 124 is prevented from rotating, thereby allowing the first mounting rod 82 to be threaded within the bushing 124.

The first mounting rod 82 is threaded within the bushing 124 until a desired length of the first mounting rod 82 extends upwardly from the bushing 124. As noted above, the bushing 124 limits the linear travel of the first mounting rod 82 within the first extension tube 76. Therefore, the bushing 124 limits the length of the first mounting rod 82 protruding from the first extension tube 76 when the first extendable arm assembly 28 is in the deployed, extended position. Thus, to shorten or lengthen the protruding first mounting rod 82, the first mounting rod 82 can be threaded further into or out of the bushing 124. This may be desired to accommodate different support structures or users of different heights.

After adjusting the first mounting rod 82 to the desired length, a rod locking mechanism 138 may be used to prevent rotation of the first mounting rod 82 within the first extension tube 76. Although any suitable mechanism may be used to prevent rotation of the first mounting rod 82 within the first extension tube 76, the depicted rod locking mechanism 138 includes a rod locking key 142 that is engageable with the first mounting rod 82.

The rod locking key 142 includes a substantially U-shaped portion 144 that is sized and shaped to surround a portion of the first mounting rod 82 and engage the opposing chamfered surfaces 140 of the first mounting rod 82. The U-shaped portion 144 is receivable within a transverse slot 150 formed within the first extension tube 76 such that the rod locking key 142 is substantially fixed in its position when received within the slot 150. A spring clip, snap-locking feature, etc. (not shown), may be provided on the first extension tube 76 to releasably retain the locking key 142 within the slot 150. The U-shaped portion 144 extends into the slot 150 and engages the chamfered surfaces 140 to prevent rotation of the first mounting rod 82 with respect to the first extension tube 76.

The rod locking key 142 includes a tab portion 146 extending from the U-shaped portion 144 that is positioned exterior of the first extension tube 76 when the U-shaped portion 144 is received therein. The tab portion 146 can be used to move the U-shaped portion 144 into and out of the slot 150.

It should be appreciated that any other suitable rod locking mechanism may instead be used to prevent rotation of the first mounting rod 82 within the first extension tube 76, such as a ball detent mechanism, a collar assembly, etc. Thus, the foregoing description should not be seen as limiting the scope of the present disclosure.

Figure 10:
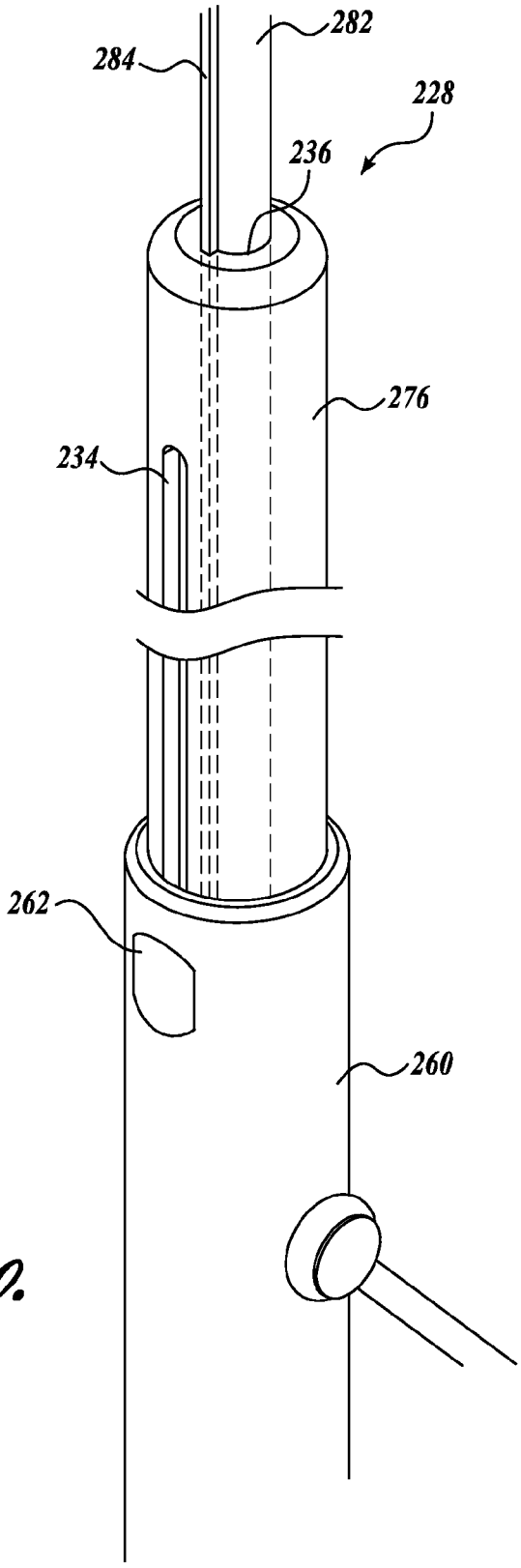
FIG. 10 is an isometric view of a portion of an alternate embodiment of an arm assembly of the portable changing table of FIG. 1.

Referring to FIG. 10, an alternate embodiment of an extendable arm assembly 228 is depicted. The extendable arm assembly 228 is substantially similar to the first extendable arm assembly 28 described above except for the differences hereinafter described. The extendable arm assembly 228 includes a mounting rod 182 slidably received within an extension tube 276, wherein the extension tube 276 is slidably received within a tubular body 260. The tubular body 260 includes an extension tube key 262 (shown partially in FIG. 10) that extends inwardly into a longitudinal slot 234 formed along the length of the extension tube 276. The key 262 prevents rotation of the extension tube 276 within the tubular body 260.

The mounting rod 182 of the extendable arm assembly 228 is non-threaded and is substantially circular in cross-section. As such, the mounting rod 182 is fixedly secured within a bushing (not shown) slidably received within the extension tube 276. This configuration may be desired where adjustment of the mounting rod 182 length is not needed. The mounting rod 182 further includes a longitudinal key 284 extending along the length of the exterior surface of the mounting rod 182. The opening 236 in the upper end of the extension tube 276 substantially corresponds to the combined cross-sectional shape of the mounting rod 182 and key 284. In this manner, the mounting rod 182 is not rotatable within the extension tube 276. Rather, the mounting rod 182 can only move linearly within the extension tube 276 between the collapsed, or retracted, positions and the deployed, or extended positions.

It can be appreciated from the foregoing that the portable changing table 20 provides a safe, convenient, clean place to perform a diaper change away from home. Furthermore, the portable changing table 20 is suitably compact and portable such that it may be easily transported and used in a variety of situations and places.

Figure 11:
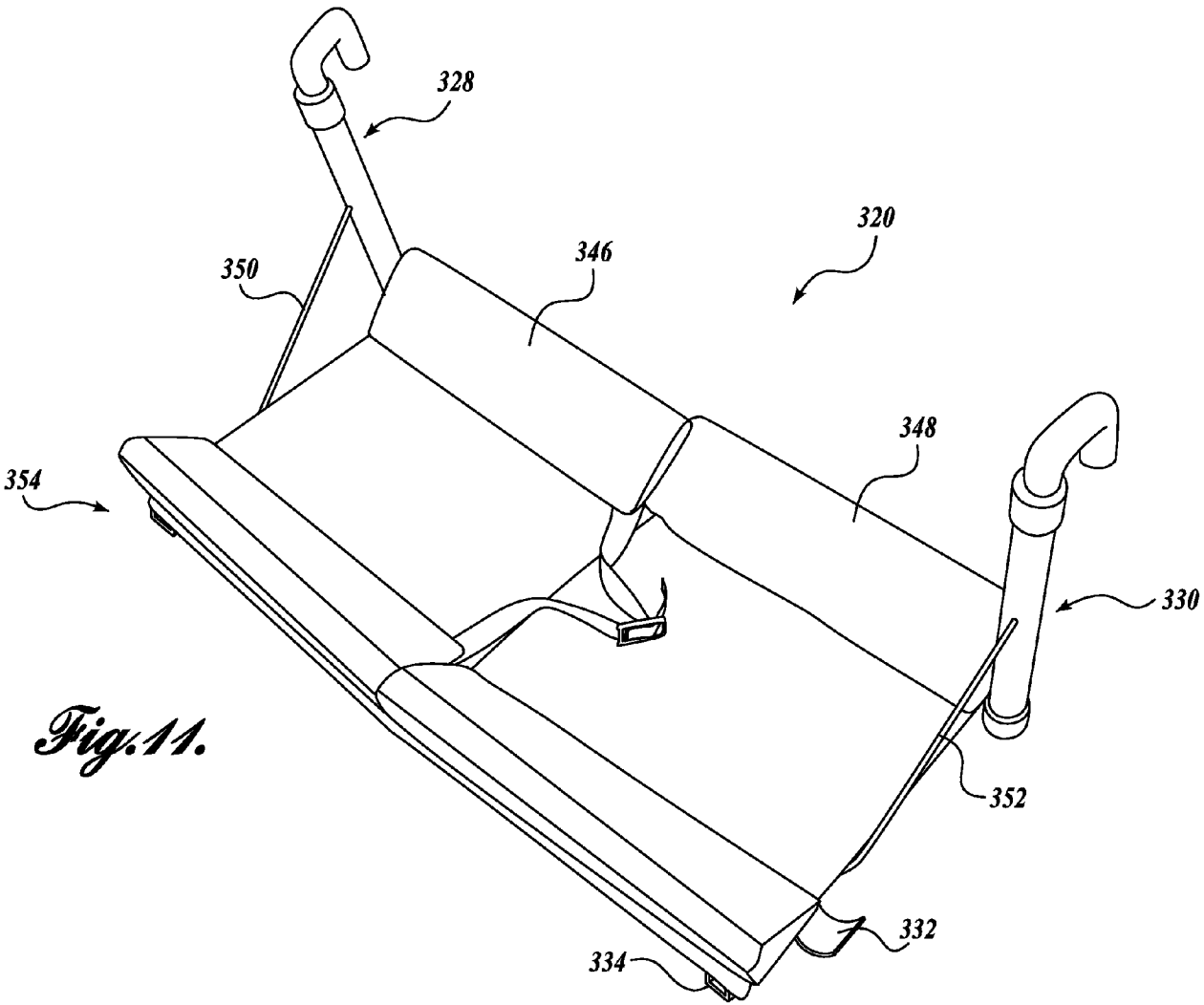
FIG. 11 is an isometric front view of a first alternate embodiment of a portable changing table formed in accordance with the present disclosure.
Figure 12:
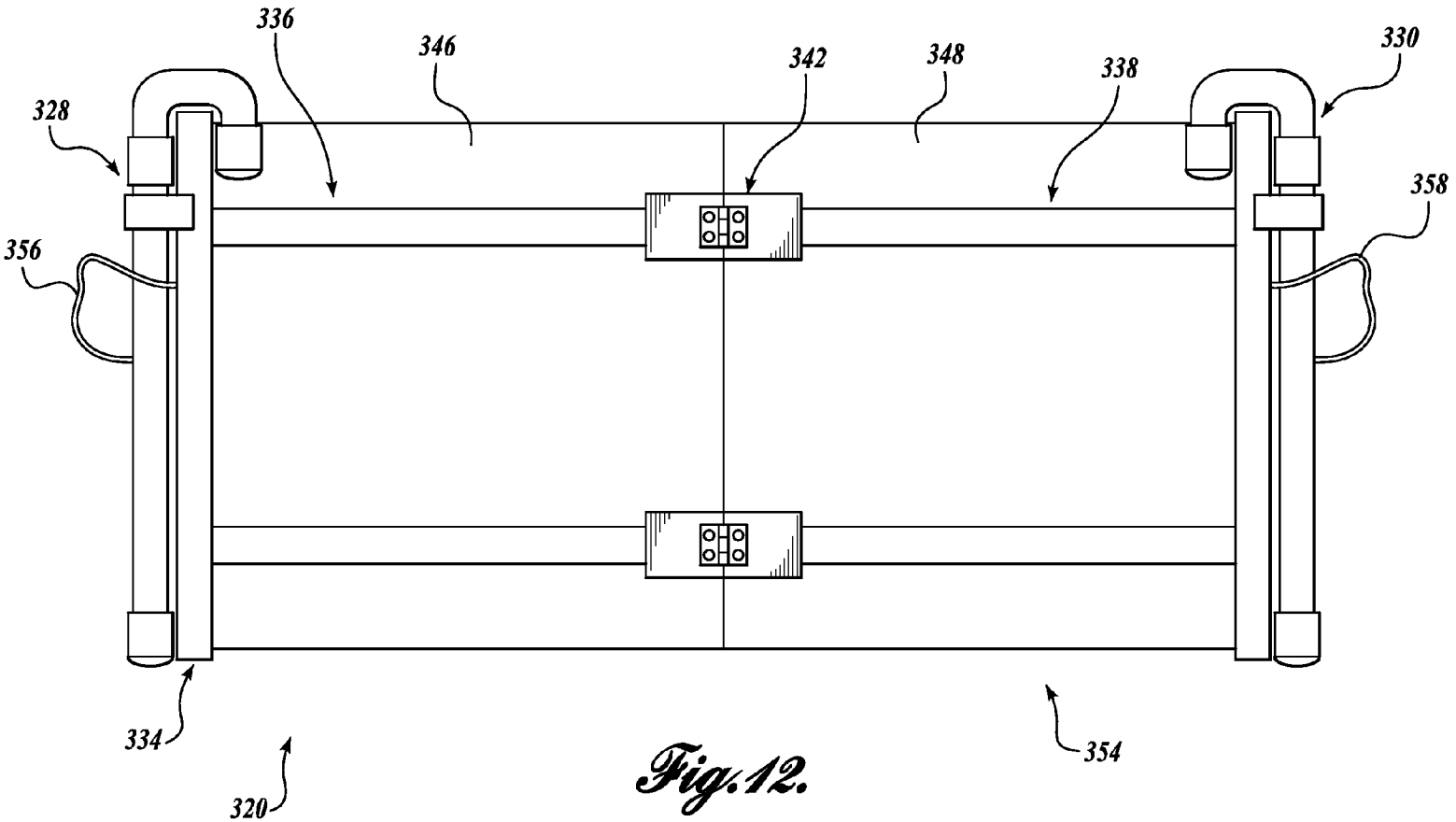
FIG. 12 is a rear planar view of the portable changing table of FIG. 11.

Referring to FIGS. 11 and 12, a first alternate embodiment of a portable changing table 320 is depicted. The portable changing table 320 includes a base 354 hingedly coupled to first and second extendable arm assemblies 328 and 330. The base 354 is defined by a frame 334 having first and second frame portions 336 and 338 that support first and second pads 346 and 348, respectively. The first and second frame portions 336 and 338 are hingedly coupled to one another by one or more hinge assemblies 342 that define a hinge pivot axis. The hinge assemblies 342 allow the first and second frame portions 336 and 338, and therefore the first and second pads 346 and 348, to fold about the hinge pivot axis into a collapsed position.

The first and second extendable arm assemblies 328 and 330 are substantially similar to the first and second extendable arm assemblies 28 and 30 described above. The first and second extendable arm assemblies 328 and 330 are hingedly coupled to a portion of the frame 334 with any suitable hinge assembly (not shown) that allows the first and second extendable arm assemblies 328 and 330 to moved between a deployed and collapsed position. In the deployed position, as shown in FIG. 11, the first and second extendable arm assemblies 328 and 330 are positioned substantially transversely to the plane of the frame 334. First and second support straps 350 and 352 may extend between the first and second extendable arm assemblies 328 and 330 and the frame 334 to position and support the frame 334 (and therefore the pads 346 and 348) in a substantially transverse position relative to the extendable arm assemblies 328 and 330.

In the collapsed position, the first and second extendable arm assemblies 328 and 330 are positioned alongside an edge of the frame 334. A clip 332 may extend from each edge of the frame 334 to receive and stow the respective extendable arm assembly in the collapsed position.

With the extendable arm assemblies 328 and 330 in the collapsed, stowed position, the frame 334 may be folded along the hinge pivot axis defined by the hinge assemblies 342. First and second handles 356 and 358 may extend from each edge of the frame 334 for carrying the portable changing table 320 in the folded configuration. The portable changing table 320 may include one or more pouches secured to the underside of the frame for storing or transporting accessories, such as diapers, wipes, etc.

Figure 13:
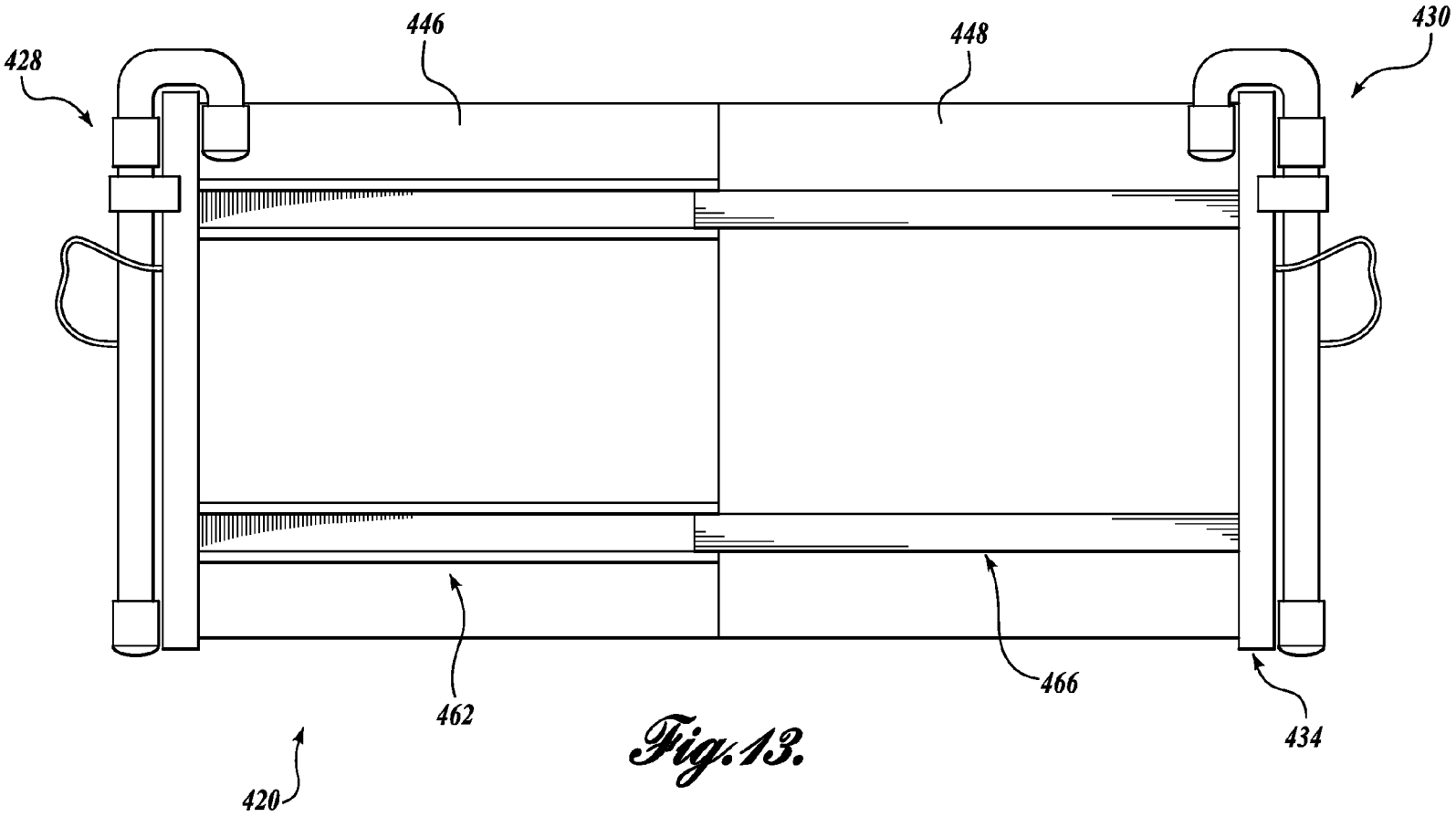
FIG. 13 is a rear planar view of a second alternate embodiment of a portable changing table formed in accordance with the present disclosure.

Referring to FIG. 13, a second alternate embodiment of a portable changing table 420 is depicted. The portable changing table 420 is substantially identical to the portable changing table 320 described above except the frame 434 is not moveable about a hinge pivot axis to collapse the table into a folded configuration. In the alternative, the frame 434 includes first and second portions that support first and second pads 446 and 448, wherein the first frame portion is defined in part by one or more slide rail tracks 462 and the second frame portion is defined in part by one or more slide rails 466. The slide rails 466 are slidably received within the slide rail tracks 462 to collapse the portable changing table 420 for transport or storage.

Figure 14:
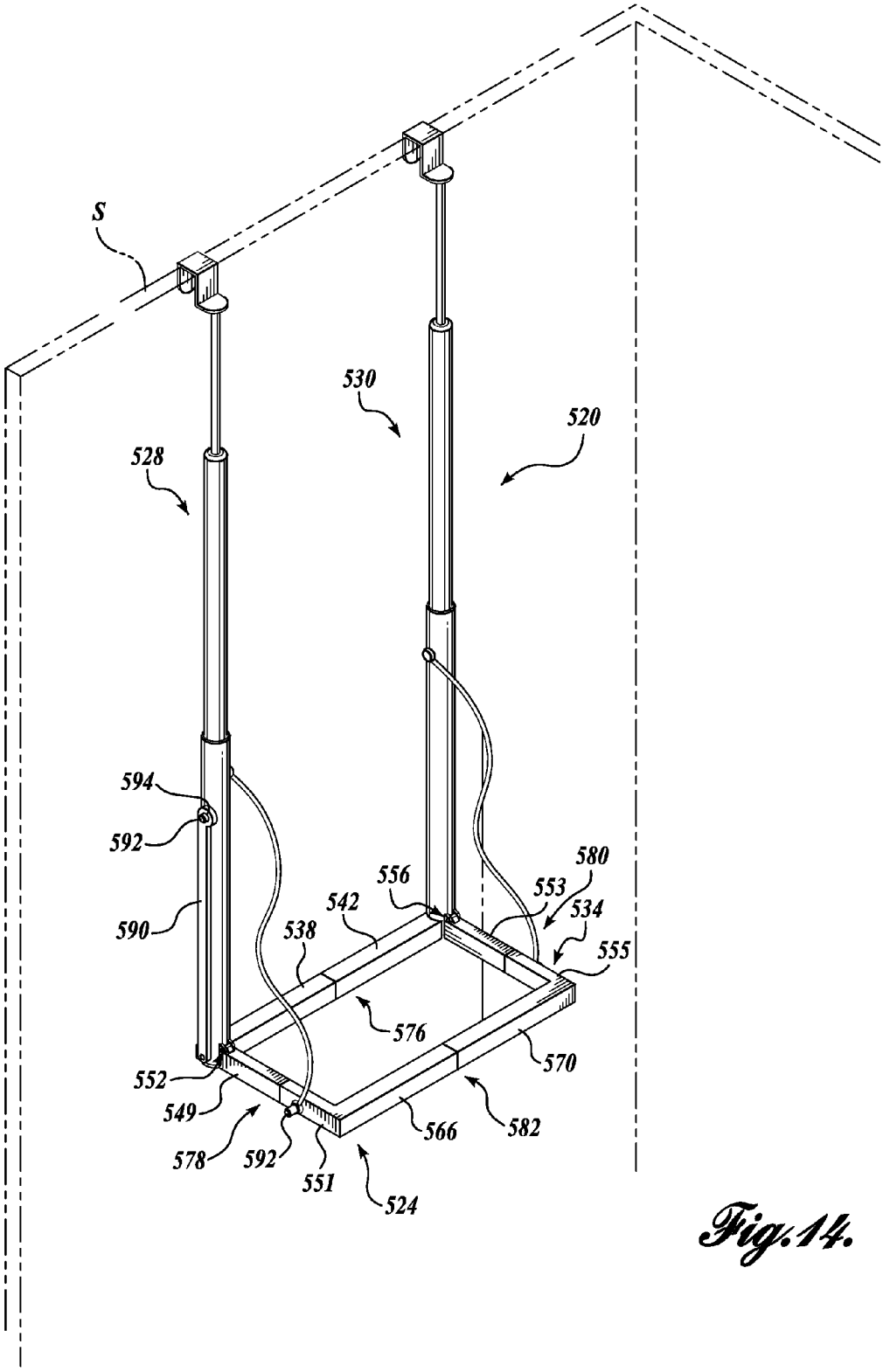
FIG. 14 is an isometric front view of a third alternate embodiment of a portable changing table formed in accordance with the present disclosure, wherein the portable changing table is shown in a first position.
Figure 15:
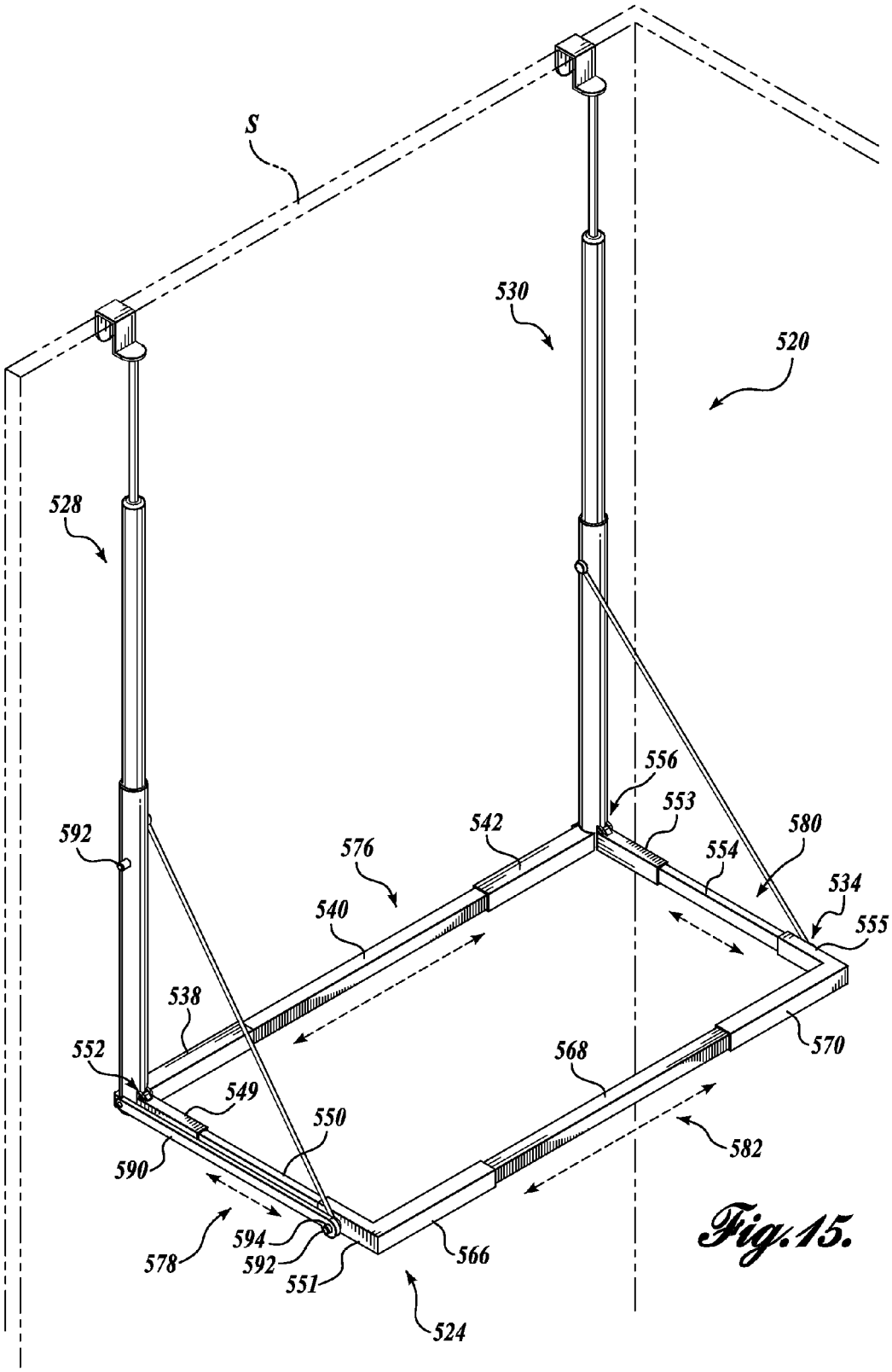
FIG. 15 is an isometric front view of the portable changing table of FIG. 14, wherein the portable changing table is shown in a second position.

Referring to FIGS. 14 and 15, a third alternate embodiment of a portable changing table 520 is depicted. The portable changing table 520 is substantially similar to the portable changing table 320 described above except the differences hereinafter provided. In that regard, the portable changing table 520 generally includes a collapsible base 524 coupled to first and second extendable arm assemblies 528 and 530. In the depicted embodiment, the first and second extendable arm assemblies 528 and 530 are substantially identical to the first and second extendable arm assemblies 28 and 30 described above. However, it should be appreciated that any suitable assemblies for removably securing the portable changing table 520 to a portion of a bathroom stall S or similar structure may instead be used.

The collapsible base 524 includes a frame 534 that is deployable into a substantially rectangular shape and a flexible support member, or diaper changing pad (not shown) secured to the frame 534. The frame 534 is comprised of a rear frame member assembly 576 having a first rear frame member 538 secured to a lower end of the first extendable arm assembly 528 at its first end. A first telescoping member 540 is telescopingly received within a second open end of the first rear frame member 538. A second rear frame member 542 is secured to a lower end of the second extendable arm assembly 530 at its first end. The first telescoping member 540 is telescopingly received within a second open end of the second rear frame member 542.

The frame 534 further includes a first side frame member assembly 578 having a first side frame member 549 hingedly coupled to a portion of the first extendable arm assembly 528 at its first end. A second telescoping member 550 is telescopingly received within a second open end of the first side frame member 549. The second telescoping member 550 is also telescopingly received within a first open end of a second side frame member 551. Similarly, a second side frame member assembly 580 includes a third side frame member 553 hingedly coupled to a portion of the second extendable arm assembly 530 at its first end. A third telescoping member 554 is telescopingly received within a second open end of the third side frame member 553. The third telescoping member 554 is also telescopingly received within a first open end of a fourth side frame member 555.

The first and third side frame members 549 and 553 are hingedly coupled to the first and second extendable arm assemblies 528 and 530 through first and second hinge assemblies 552 and 556. The first and second hinge assemblies 552 and 556 may be any suitable hinge assemblies configured to allow the first and third side frame members 549 and 553 to move between a collapsed position, wherein the first and third side frame members 549 and 553 are positioned substantially adjacent to and parallel to the longitudinal axes of the first and second extendable arm assemblies 528 and 530, respectively (not shown), and a deployed position, wherein the first and third side frame members 549 and 553 are substantially transverse to the longitudinal axes of the first and second extendable arm assemblies 528 and 530, respectively (see FIG. 15). In the deployed position, the first and third side frame members 549 and 553 are also substantially transverse to the first and third rear frame members 538 and 542.

The frame further includes a front frame member assembly 582 having a first front frame member 566 secured to the second side frame member 551 at a first end such that the first front frame member 566 is substantially transverse to the second side frame member 551. The first front frame member 566 is secured to the second side frame member 551 in any suitable manner. As a non-limiting example, the first front frame member 566 may be integrally formed with the second side frame member 551 to define a substantially L-shaped member.

A fourth telescoping member 568 is telescopingly received within a second open end of the first front frame member 566. The fourth telescoping member 568 is also telescopingly received within a first open end of a second front frame member 570. The first end of the second front frame member 570 is secured to the fourth side frame member 555 such that the second front frame member 570 is substantially transverse to the fourth side frame member 555. The second front frame member 570 may be integrally formed with the fourth side frame member 555 or otherwise secured thereto in a suitable manner to define a substantially L-shaped member.

The rear, front, and first and second side frame member assemblies 576, 582, 578 and 580 enable the frame 534 to move between an expanded, deployed position and shortened, collapsed position. More specifically, the first telescoping member 540 is slidable into and out of the first and second rear frame members 538 and 542 to expand and shorten the overall length of the rear frame member assembly 576. At the same time, the fourth telescoping member 568 is slidable into and out of the first and second front frame members 566 and 570. As such, the rear and front frame member assemblies 576 and 582 are used to increase or decrease the overall length of the frame 534.

Similarly, the second telescoping member 540 is slidable into and out of the first and second side frame members 549 and 551 to expand and shorten the overall length of the first side frame member assembly 578. At the same time, the third telescoping member 554 is slidable into and out of the third and fourth side frame members 553 and 555. As such, the first and second side frame member assemblies 578 and 580 are used to increase or decrease the overall width of the frame 534.

It should be appreciated that the rear, front, and first and second side frame member assemblies 576, 582, 578 and 580 may be comprised of more than one telescoping member without departing from the scope of the present disclosure. For instance, with regard to the rear frame member assembly 576, each end of the first telescoping member 540 may be slidably received within fifth and sixth telescoping members, with the fifth and sixth telescoping members slidably received within the open ends of the first and second rear frame members 538 and 542. Additional telescoping members may be used decrease the overall length of the rear frame member assembly 576 in the collapsed position. The front frame member assembly 582 and the first and second side frame member assemblies 578 and 580 could be modified similarly.

In addition, the frame 534 may instead include telescoping members within only the front and rear frame member assemblies 576 and 582, or within only the first and second side member assemblies 578 and 580. For instance, the first and second side member assemblies 578 and 580 may be comprised of a rigid member that is not expandable and that extends between the front and rear frame member assemblies 576 and 582. As such, the frame 534 would be modifiable in only length.

The collapsible frame 534 may also include one or more locking mechanisms for temporarily securing the frame 534 in at least one of the expanded and collapsed positions. For instance, the locking mechanism may comprise a bracket or arm 590 that is pivotally attached to the bottom end of the first extendable arm assembly 528. A through-hole 594 may be defined at the end of the arm 590 for received a spring-loaded pin or detent 592 therein. A detent 592 may be disposed on both the first extendable arm assembly 528 and the second side frame member 551 of the first side frame member assembly 578. As such, the arm 590 may be moveable between an unlocked position, wherein the through-hole 594 receives the detent on the first extendable arm assembly 528, and a locked position, wherein the through-hole 594 receives the detent on the second side frame member 551. In the locked position, the arm 590 prevents the collapse of the first side frame member assembly 578. Additional lock arms may be used in addition to or in lieu of the lock arm 590 to selectively secure the second side frame member assembly 580 in a locked position or at least one of the front or rear frame member assemblies 582 or 576.

In the alternative, the locking mechanism may comprise a latch mechanism having features similar to the latch mechanism 100 described above. As yet another example, the locking mechanism may be defined by a lock detent having a spring-loaded ball or clip secured within the telescoping member that is receivable within a opening in the frame members slidably engaged with the telescoping member. For instance, lock detents on each end of the second telescoping member 550 may be securable within openings in the first and second side frame members 549 and 551 to selectively secure the first side frame member assembly 578 in the deployed position.

To use the portable changing table 520, the first and second extendable arm assemblies 528 and 530 are secured to a bathroom stall S or other desired structure. The first and third side frame members 549 and 553 may then be pivoted about the hinge assemblies 552 and 556 to move the frame 534 into the deployed, lowered position (i.e., with the first and third frame members 549 and 553 positioned substantially transversely to the first and second extendable arm assemblies 528 and 530).

With the frame 534 in the deployed position, the rear, front, and first and second side frame member assemblies 576, 582, 578 and 580 may be moved into the expanded position. In the expanded position, the diaper changing pad (not shown) extends across the frame 534 to receive a baby thereon.

Figure 16:
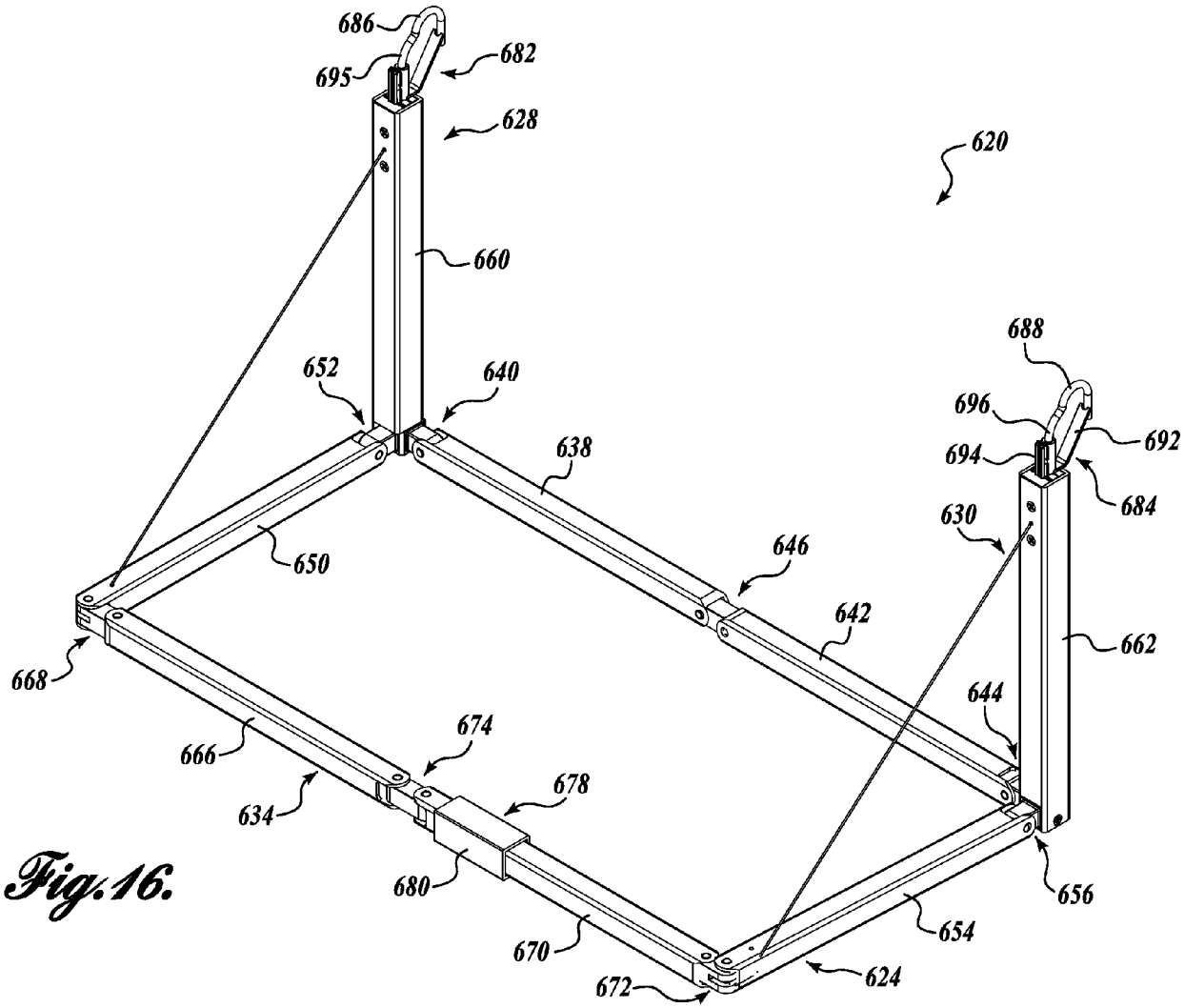
FIG. 16 is a front isometric front of a fourth alternate embodiment of a portable changing table formed in accordance with the present disclosure.

Referring to FIG. 16, a fourth alternate embodiment of a portable changing table 620 is depicted. The portable changing table 620 is substantially similar to the portable changing table 20 described above except for the differences hereinafter provided. In that regard, the portable changing table 620 generally includes a collapsible base 624 coupled to first and second extendable arm assemblies 628 and 630. The collapsible base 624 is defined by a frame 634 having frame members hingedly coupled to one another and hingedly coupled to the first and second arm assemblies 628 and 630. Any suitable hinge assembly may be used to hingedly couple the frame 634 to the first and second extendable arm assemblies 628 and 630 and to hingedly couple the frame members together.

The frame 634 includes a first rear frame member 638 hingedly coupled to the first extendable arm assembly 628 at its first end through a first rear hinge assembly 640, and it further includes a second rear frame member 642 hingedly coupled to the second extendable arm assembly 630 at its first end through a second rear hinge assembly 644. The first and second rear frame members 638 and 642 are hingedly coupled to one another at their second ends through a middle rear hinge assembly 646.

The frame 634 further includes first and second side frame members 650 and 654 extending from and hingedly coupled to the first and second extendable arm assemblies 628 and 630 through first and second side hinge assemblies 652 and 656, respectively. The first and second side frame members 650 and 654 are hingedly coupled at their second ends to the first ends of first and second front frame members 666 and 670 through first and second front hinge assemblies 668 and 672, respectively. The first and second front frame members 666 and 670 are hingedly coupled together at their second ends through a middle front hinge assembly 674.

The frame 634 is moved between collapsed and deployed positions by moving the frame members about pivot axes defined by the hinge assemblies. In the deployed position, as shown in FIG. 16, the frame 634 is positioned substantially transversely to the first and second extendable arm assemblies 628 and 630. In this deployed position, a flexible support member, such as a diaper changing pad (not shown) may extend across the frame 634 to receive a baby thereon.

To move the frame 634 into the collapsed position, the frame members are moved about the corresponding hinge assemblies to position each of the frame members in a substantially upright position (as shown in FIG. 2 for the portable changing table 20). In the collapsed position, the portable changing table 620 is suitable to be stowed and transported within, for instance, a diaper bag or a purse.

A hinge locking mechanism 678 may be secured to a portion of the first and second front frame members 666 and 670 to temporarily lock the front frame members 666 and 670 in the deployed position, similar to the latch mechanism 100 described above. In this depicted embodiment, the hinge locking mechanism 678 is defined by a tubular member 680 that is slidably disposed on one of the first and second front frame members 666 and 670. With the frame 634 in the deployed position, the tubular member 680 is slidable over a portion of both the first and second front frame members 666 and 670 and the middle front hinge assembly 674. With the tubular member 680 extending across the middle front hinge assembly 674, the first and second front frame members 666 and 670 cannot move about the pivot axis defined by the middle front hinge assembly 674. As such, the first and second front frame members 666 and 670 are temporarily locked in the deployed position.

A locking feature (not shown), such as a ball detent or other snap-lock feature, may be disposed between one of the first or second front frame members 666 and 670 and the tubular member 680 for selectively securing the tubular member 680 in the locking position. For instance, the locking feature may be defined by a lock detent having a spring-loaded ball or clip disposed within one of the first or second front frame members 666 and 670 and receivable within a corresponding hole formed in the tubular member 680. The lock detent may be depressed when sliding the tubular member 680 into and out of the locking position. It should be appreciated that any suitable detent mechanism or supplemental locking device may instead be used.

Still referring to FIG. 16, the first and second extendable arm assemblies 628 and 630 will now be described in further detail. In the depicted embodiment, the first and second extendable arm assemblies 628 and 630 are substantially similar to the first and second extendable arm assemblies 28 and 30 described above. In that regard, the first and second extendable arm assemblies 628 and 630 are of a suitable design such that the assemblies may be moved between a retracted, stowed position (similar to arm assemblies 28 and 30 shown in FIG. 2) and an extended, deployed position (similar to arm assemblies 28 and 30 shown in FIG. 1). As with first and second extendable arm assemblies 28 and 30, first and second extendable arm assemblies 628 and 630 have telescoping features and biasing members (not shown) to allow the first and second extendable arm assemblies 628 and 630 to move between the retracted and the extended positions and to urge the assemblies into the retracted position.

The telescoping features of the first and second extendable arm assemblies 628 and 630 are defined at least in part by first and second extendable mounting rods 695 and 696 slidable within first and second tubular members 660 and 662. The extendable rods 695 and 696 are coupled to or otherwise terminate at their upper ends in first and second hook portions 686 and 688 of first and second hook safety latch assemblies 682 and 684. The first and second hook member assemblies 682 and 684 are configured to suitably mount the first and second extendable arm assemblies 628 and 630 to a support structure, such as the upper edge of a bathroom stall S (see FIG. 1), a railing, or similar. In that regard, the first and second hook portions 686 and 688 are substantially U-shaped or any other suitable shape for hanging on an upper edge of a mounting member, such as a bathroom stall, railing, etc.

The first and second hook safety latch assemblies 682 and 684 are substantially identical; therefore, only the second hook safety latch assembly 684 will be described in detail. The second hook safety latch assembly 684 is defined by a first latch portion 692 that extends from a mounting portion 694 secured to or otherwise disposed around the second extendable rod 696 of the second extendable arm assembly 630. The first latch portion 692 is connected to or otherwise extends from the mounting portion 694 toward the interior end portion of the second hook portion 688.

The first latch portion 692 is deformable or bendable inwardly away from the second hook portion 688 to allow the second hook portion 688 to be secured onto a stall, railing, etc. When the first latch portion 692 is deformed inwardly away from the second hook portion 688, the first latch portion 692 is urged continuously against the stall, railing, etc., due to the elastic properties of the first latch portion 692. In this manner, the first latch portion 692 imposes a securing force on the stall, railing, etc., to help secure and stabilize the second hook portion 688 thereon. When the hook portion 688 is removed from the stall, railing, etc., the first latch portion 692 is urged back into its original position against the interior end portion of the second hook portion 688. Thus, the first latch portion 692 automatically helps secure the hook portion 688 on the stall, railing, etc., when the second hook portion 688 is secured thereon.

Both the mounting portion 694 and the first latch portion 692 may be formed from plastic or another suitable material such that the first latch portion 692 is elastically deformable away from the second hook portion 688. The mounting portion 694 and first latch portion 692 may be injection molded as one part or otherwise formed in any other suitable manner.

Figure 17:
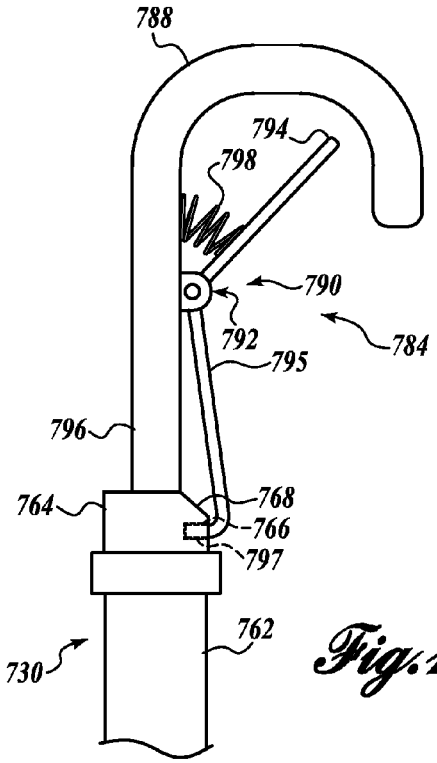
FIG. 17 is a side view of a first alternate embodiment of a safety latch assembly for use with a portable changing table, wherein the safety latch assembly is shown in a first, locked position.
Figure 18:
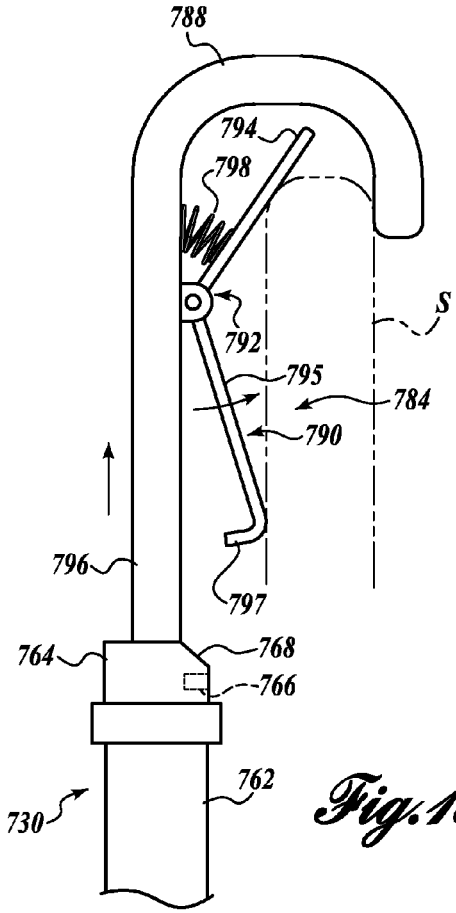
FIG. 18 is a side view of the safety latch assembly of FIG. 17, wherein the safety latch assembly is shown in a second, unlocked position.

Referring to FIGS. 17-18, a first alternate embodiment of a hook safety latch assembly 784 for use with an extendable arm assembly 730 is depicted. The hook safety latch assembly 784 may be configured for use with the portable changing table 620 or any other portable changing table described above. The hook safety latch assembly 784 is configured to help stabilize and secure a hook portion 788 of an extendable rod 796 against a stall, railing assembly, etc., similar to the second hook safety latch assembly 684 described above. However, the hook safety latch assembly 784 is additionally configured to secure the extendable rod 796 in a retracted position when not in use.

The hook safety latch assembly 784 includes a latch or lever arm 790 pivotally secured to the extendable rod 796 of the extendable arm assembly 730. The extendable rod 796 extends from and is slidable within a tubular member 762 similar to that described above with extendable arm assemblies 30 and 630.

The lever arm 790 is pivotally secured to an upper end of the extendable rod 796 through a fulcrum or pivot 792. The lever arm 790 includes an upper lever arm portion 794 and a lower lever arm portion 795 extending upwardly and downwardly from the pivot 792, respectively, and away from the extendable rod 796. The upper lever arm portion 794 defines a first latching portion that extends toward the interior end of the hook portion 788. In that regard, a latch biasing member, such as a spring 798, is disposed between the extendable rod 796 and the upper lever arm portion 794 to continuously urge the upper lever arm portion 794 toward the interior end of the hook portion 788. Thus, when the hook portion 788 is secured on a bathroom stall, railing, etc., the upper lever arm portion 794 is continuously urged into engagement against the stall, railing, etc., to help stabilize and secure the hook portion 788 thereon.

It can be appreciated that with the latch biasing member 798 urging the upper lever arm portion 794 toward the interior end of the hook portion 788, the lower lever arm portion 795 is continuously urged toward the extendable rod 796. Thus, in a resting position, the lower lever arm portion 795 is engageable with the extendable rod 796.

The lower lever arm portion 795 includes a second latching portion 797 defined at its lower end that extends from the lower lever arm portion 795 toward the extendable rod 796. The second latching portion 797 is receivable within a latch-receiving slot 766 of a collar 764 disposed at the upper end of the tubular member 762. The extendable rod 796 is slidable within the collar 764 for moving the extendable rod 796 between the retracted and extended positions.

In the retracted position, as shown in FIG. 17, the second latching portion 797 is urged into engagement with and received within the latch receiving slot 766, and the upper lever arm portion 794 is urged toward the hook portion 788. To move the extendable arm assembly 730 into the extended position, the hook portion 788 is placed on a stall, railing assembly, etc. For example, FIG. 18 depicts the hook portion 788 being placed on the upper edge of a bathroom stall member S. When the bathroom stall member S is received within the hook portion 788, the bathroom stall member S depresses the upper lever arm portion 794 inwardly toward the extendable rod 796. As the upper lever arm portion 794 is depressed inwardly, the lever arm 790 pivots about pivot 792 to move the lower lever arm portion 795 away from the extendable rod 796.

When the lower lever arm portion 795 moves away from extendable rod 796, the second latching portion 797 comes out of engagement with the latch receiving slot 766 of collar 764. In this manner, the extendable rod 796 is no longer locked in a retracted position. Rather, the extendable rod 796 may extend outwardly from tubular member 762 to move the collapsible portable changing table 620 into a deployed position for use. With the extendable arm assembly 730 in the deployed, extended position, the upper lever arm portion 794 also maintains a biased engagement with the bathroom stall member S to help secure the hook portion 788 on the bathroom stall member S.

To move the extendable arm assembly 730 back into the retracted position, as shown in FIG. 17, the hook portion 788 is lifted off of the bathroom stall member S. When disengaged from the bathroom stall member S, the upper lever arm portion 794 is urged back toward the inner end of the hook portion 788 by spring 798. At the same time, lower lever arm portion 795 is urged back into engagement with extendable rod 796. A biasing member (not shown) inside the tubular member 762 retracts the extendable arm 796 within the tubular member 762. As the extendable rod 796 moves into a fully refracted position, the second latching portion 797 of the lower lever arm portion 795 engages a ramped portion 768 on an upper end of the collar 764, allowing the second latching portion 797 to continue to travel downwardly along the collar 764 and into the latch-receiving slot 766. With the second latching portion 797 received within the latch-receiving slot 766, the extendable rod 796 is secured in the retracted position until used again.

It should be appreciated that the hook safety latch assembly 784 may be instead configured in any other suitable manner. For instance, the extendable rod 796 may include a spring-loaded detent that is engageable with a slot in the collar 764 when the extendable rod 796 is retracted. In such an embodiment, the detent would be depressed to unlock the extendable rod 796 and move it upwardly into the deployed position. Thus, the foregoing description and illustrations provided herein should not be seen as limiting the claimed subject matter.

Figure 19:
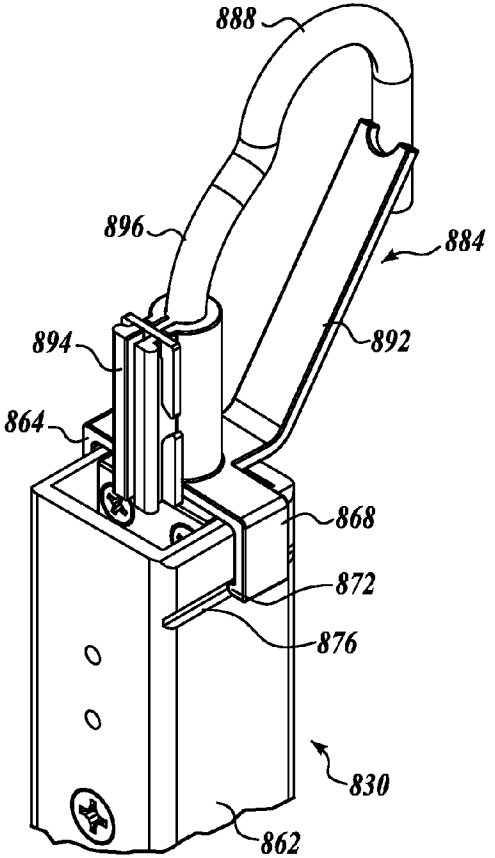
FIG. 19 is a front isometric view of a second alternate embodiment of a safety latch assembly for use with a portable changing table, wherein the safety latch assembly is shown in a first, locked position.
Figure 20:
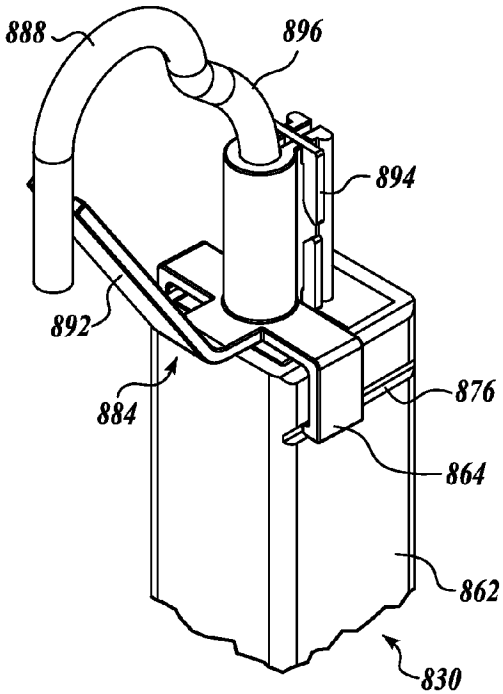
FIG. 20 is a rear isometric view of the safety latch assembly of FIG. 19.
Figure 21:
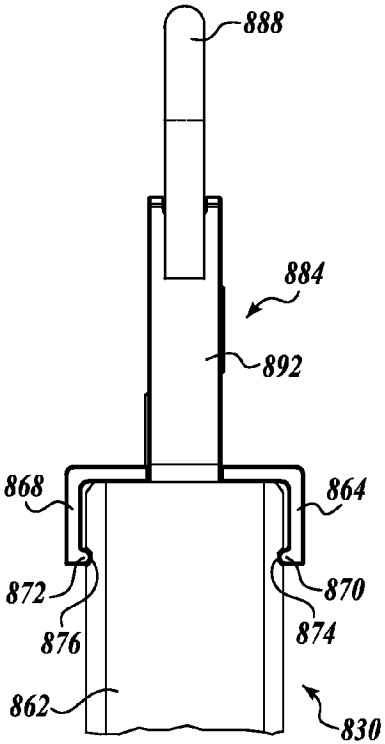
FIG. 21 is a rear view of the safety latch assembly of FIG. 19.

Referring to FIGS. 19-21, a second alternate embodiment of a hook safety latch assembly 884 for use with an extendable arm assembly 830 is depicted. The hook safety latch assembly 884 may be configured for use with the portable changing table 620 or any other portable changing table described above. Like the hook safety latch assembly 784, the hook safety latch assembly 884 is configured to help stabilize and secure a hook portion 888 of an extendable rod 896 against a stall, railing assembly, etc. Moreover, the hook safety latch assembly 884 is configured to secure the extendable rod 896 in a retracted position within the tubular member 862 when not in use.

The hook safety latch assembly 884 includes a first latch portion 892 extending towards an interior end portion of the hook portion 888 from a mounting portion 894 secured to or otherwise disposed around the extendable rod 896 of the extendable arm assembly 830. The first latch portion 892 is deformable or bendable inwardly away from the hook portion 888 to allow the hook portion 888 to be secured onto a stall, railing, etc. When the first latch portion 892 is deformed inwardly away from the hook portion 888, the first latch portion 892 is urged continuously against the stall, railing, etc., due to the elastic properties of the latch portion 892. In this manner, the first latch portion 892 imposes a securing force on the stall, railing, etc., to help secure and stabilize the second hook portion 888 thereon.

When the hook portion 888 is removed from the stall, railing, etc., the first latch portion 892 is urged back into its original position against the interior end portion of the second hook portion 888. Thus, the first latch portion 892 automatically helps secure the hook portion 888 on the stall, railing, etc., when the second hook portion 888 is secured thereon.

The hook safety latch assembly 884 further includes second and third latch portions 864 and 868 that are selectively engageable with the tubular member 862 of the extendable arm assembly 830 in the retracted position to selectively secure the extendable arm assembly 830 in the retracted position. The second and third latch portions 864 and 868 extend in substantially opposite horizontal directions from the mounting portion 894 along the top of the tubular member 862. The second and third latch portions 864 and 868 continue to extend downwardly along the side of the tubular member 862, thereby defining an overall "C-shaped" latching member engageable with the top end of the tubular member 862.

Each latch portion 864 and 868 includes a protrusion 870 and 872, respectively, protruding from its interior end that it receivable within a substantially transverse groove 874 and 876, respectively, formed within the exterior of the tubular member 862 when the extendable arm assembly 830 is in the retracted position. Thus, when the extendable arm assembly 830 is in the retracted position, the upper end of the tubular member is received within the C-shaped latching member defined by the second and third latch portions 864 and 868, and the protrusions 870 and 872 are receivable within the grooves 874 and 876.

Like the first latching portion 892, the second and third latch portions 864 and 868 are deformable such that the protrusions 870 and 872 may be moved into and out of the grooves 874 and 876 between locked and unlocked positions. More specifically, the second and third latch portions 864 and 868 can be deformed outwardly away from the tubular member 862 to disengage the protrusions 870 and 872 from the grooves 874 and 876 and move the hook safety latch assembly 884 into an unlocked position.

Although the second and third latch portions 864 and 868 may be deformed outwardly into the unlocked position in any suitable manner, it should be appreciated that the second and third latch portions 864 and 868 may simply be urged into the unlocked position by pulling the extendable rod 896 out from within the tubular member 862 when, for instance, the hook portion 888 is secured on a bathroom stall, railing, etc.

In that regard, the second and third latch portions 864 and 868 may be urged back into the locked position by retracting the extendable rod 896 within the tubular member 862 into the collapsed position. When the protrusions 870 and 872 are moved into grooves 874 and 876, a tactile "snap-lock" sensation is provided to the user to indicate that the extendable arm assembly 830 is in a fully retracted, locked position.

The mounting portion 694, first latch portion 692, and the second and third latch portions 864 and 868 may be formed from plastic or another suitable material such that they are elastically deformable. The mounting portion 694, first latch portion 692, and the second and third latch portions 864 and 868 may be injection molded as one part or otherwise formed in any other suitable manner.

While illustrative embodiments have been illustrated and described, it will be appreciated that various changes can be made therein without departing from the spirit and scope of the present disclosure.

The embodiments of the present disclosure in which an exclusive property or privilege is claimed are defined as follows:

1. A portable changing table, comprising:

(a) at least one extendable arm assembly moveable between a retracted position and an extended position, the at least one extendable arm assembly removably securable to a support structure, wherein the at least one extendable arm assembly includes a biasing member for urging the at least one extendable arm assembly into the retracted position;

(b) a latch assembly in communication with the at least one extendable arm assembly, the latch assembly configured to selectively secure the at least one extendable arm assembly in the retracted position;

(c) a collapsible frame hingedly secured to the at least one extendable arm assembly, the collapsible frame moveable between a stowed position and a deployed position; and (d) a flexible support member secured to a portion of the collapsible frame, the flexible support member extending across the portion of the collapsible frame in the deployed position.

2. The portable changing table of claim 1, further comprising a locking mechanism secured on the collapsible frame that is configured to selectively lock the collapsible frame in the deployed position.

3. The portable changing table of claim 1, wherein the at least one extendable arm assembly includes a mounting rod having a first end slidably received within a tubular member, a second end protruding from a first end of the tubular member, and a hook portion defined at the second end.

4. The portable changing table of claim 3, wherein the latch assembly includes a latch selectively engageable with a portion of the tubular member for selectively securing the at least one extendable arm assembly in the retracted position.

5. The portable changing table of claim 4, further comprising a latch biasing member for urging the latch into engagement with the portion of the tubular member.

6. The portable changing table of claim 5, wherein the latch is defined by a lever arm pivotally secured to the mounting rod, the latch having an upper lever arm portion extending towards the hook portion and a lower lever arm portion selectively engageable with the portion of the tubular member.

7. The portable changing table of claim 6, wherein the latch biasing member urges the upper lever arm portion toward the hook portion and urges the lower lever arm portion into engagement with a portion of the extension tube.

8. The portable changing table of claim 4, wherein the latch is defined by first and second latch portions extending from the mounting rod that are selectively engageable with first and second grooves defined within the tubular member.

9. The portable changing table of claim 8, wherein the first and second latch portions include first and second protrusions receivable within the first and second grooves.

10. The portable changing table of claim 9, wherein the first and second latch portions are elastically deformable.

11. The portable changing table of claim 1, wherein the collapsible frame is foldable about a hinge assembly.

12. The portable changing table of claim 1, further comprising first and second extendable arm assemblies moveable between the retracted and extended positions.

13. The portable changing table of claim 12, wherein the collapsible frame comprises:

(a) a first rear frame member hingedly secured to the first extendable arm assembly at a first end and a second rear frame member hingedly secured to the second extendable arm assembly at a first end, the first and second rear frame members hingedly coupled together at their second ends;

(b) a first side frame member hingedly secured to the first extendable arm assembly at a first end and a second side frame member hingedly secured to the second extendable arm assembly at a first end; and (c) a first front frame member hingedly secured to the first side frame member at a first end and a second front frame member hingedly secured to the second side frame member at a first end, the first and second front frame members hingedly coupled together at their second ends.

14. The portable changing table of claim 13, wherein the rear, side, and front frame members are moveably about hinge assemblies between a collapsed and deployed position.

15. The portable changing table of claim 13, further comprising a locking mechanism secured on the collapsible frame that is configured to selectively lock the first and second front frame members in the deployed position.

16. The portable changing table of claim 15, wherein the locking mechanism includes a tubular member slidably disposed on the first and second front frame members.

* * * * *